US005687506A

United States Patent [19]

Davies et al.

[11] Patent Number: 5,687,506

[45] Date of Patent: *Nov. 18, 1997

[54] PARALLEL BALANCE SYSTEMS

[75] Inventors: Bob Davies; Sean Davies; Shaul Goldenberg; Sinnathamby Kupenthirarajan, all of Weston, Canada

[73] Assignee: 420820 Ontario Limited, c.o.b. Preferred Engineering Inc., Vaughan, Canada

[ * ] Notice: The term of this patent shall not extend beyond the expiration date of Pat. No. 5,682,710.

[21] Appl. No.: 362,995

[22] Filed: Dec. 23, 1994

Related U.S. Application Data

[63] Continuation-in-part of Ser. No. 281,620, Jul. 28, 1994.

[51] Int. Cl.[6] ..... E05D 15/58

[52] U.S. Cl. ..... 49/260; 49/261

[58] Field of Search ..... 491/260, 261, 491/158, 159, 160, 162, 155, 177, 176, 178, 187

[56] References Cited

U.S. PATENT DOCUMENTS

| | | | |
|---|---|---|---|
| 1,103,377 | 7/1914 | Potter | 49/177 |
| 1,341,366 | 5/1920 | Fournier . | |
| 1,600,796 | 9/1926 | Campbell . | |
| 4,571,885 | 2/1986 | Uemura et al. | 49/177 |
| 5,058,321 | 10/1991 | Harbom et al. | 49/177 |
| 5,289,656 | 3/1994 | Truth | 49/250 |
| 5,414,960 | 5/1995 | O'Donnell et al. | 49/177 |

FOREIGN PATENT DOCUMENTS

| | | |
|---|---|---|
| 657436 | 9/1951 | United Kingdom . |

*Primary Examiner*—Anthony Knight
*Assistant Examiner*—Curtis Cohen
*Attorney, Agent, or Firm*—Neil H. Hughes; Ivor M. Hughes; Marcelo K. Sarkis

[57] ABSTRACT

A closure assembly is provided including a track and a slidable and pivotable closure member. The closure member is engaged with the track proximate first and second pivots adjacent the pivotable end of the member, the first and second pivots being interconnected by a multiple segment shaft (for example at least two portions) (for example telescoping) which provides for accurate installation, retention, removal, adjustment and alignment of the first and second pivots in a substantially parallel line for pivotally supporting the closure member so that it may be safely and securely pivoted away from the closure assembly. Improvements to the abovementioned structure are also provided.

27 Claims, 25 Drawing Sheets

PARALLEL BALANCE SYSTEMS

This application is a continuation in part of U.S. patent application Ser. No. 08/281,620 filed Jul. 28, 1994 from which priority is claimed.

FIELD OF INVENTION

This invention relates to a mounting system for a closure member in an assembly and improvements thereof which allows the secure sliding and subsequent pivoting of the closure member from a position parallel to the assembly, wherein sliding of the closure member is allowed, to a fully pivoted position. The invention is preferably embodied in a window assembly but finds application also in large pivoting windows and patio doors.

BACKGROUND OF THE INVENTION

Double hung windows are well known in the art. There are a multiplicity of examples of such double hung windows which incorporate window frames for the sliding of a window sash within a jamb guide. Further there are many examples within the prior art which allow for the sliding of a window sash within a frame within the jamb channels thereof which further incorporate a carrier or shoe attached to the window sash which allows for the pivoting of the window sash away from the window frame.

A multiplicity of designs for sliding patio doors further exist within the prior art. A typical patio door is made up of one stationary framed main glass panel and one moveable framed main glass panel sliding in a horizontal direction adjacent the stationary panel and which does not typically pivot. The weight of the patio door would require a substantial device in order to allow for the secured pivoting thereof. Such hardware would further eliminate or minimize the door sagging out of position and the need for realignment of the doors when pivoted back to the closed position. The pivoting of patio doors would be quite attractive and would allow for the marketing of large French type doors in the industry. No such doors exist within the market place at the present time.

Further within the prior art there is taught a tilt slider and the hardware therefore as taught in U.S. Pat. No. 4,888,915 issued Dec. 26, 1989, U.S. Pat. No. 5,168,665 and co-pending application 07/677,135 filed Mar. 29, 1991 manufactured and distributed by Canadian Thermo Windows, whose office is in Toronto, Canada. The manufacture of tilt and slide windows, double hung windows, patio doors, and similar structures according to the teachings of the above mentioned three references obviated many of the prior art problems which will generally occur when any pivot block provided at the pivoting end of the window sash moves out of alignment in relation to the upper or lower pivot block adjacent the same lineal of the closure member. The only means for securing the sash of the window to the pivot block previously has been either a pin or strut. The continuing motion and sliding of the windows back and forth and the pivoting thereof causes the windows to misalign and sag under the weight of gravity especially when manufactured in a vertical tilt slider. U.S. Pat. No. 4,888,915 and the above mentioned other references overcame this problem by an improved bracing system of the closure in the closure assembly by interconnecting the shoes in a carrier assembly and including with some embodiments a braking mechanism to ensure the window cannot slide when pivoted or a locking mechanism to ensure that the window cannot pivot when sliding in a track. In this way parallelism of the pivots whether stationary or in motion was assured by the required locking of the closure member. Such an assembly although much improved over the prior art has the drawback of requiring the user to latch and unlatch a number of levers to operate the window in its various modes of operation. This is primarily necessary to ensure that the pivots stay substantially parallel at all times so that for example the window is locked while pivoting thereby ensuring parallelism, or that the window is locked in the track while sliding also ensuring through the interconnection of the shoes a constant spacing and hence substantially parallel running as well. It is therefore desirable to eliminate as much of the consumer interaction with the window assembly as possible and make the operation as simple and fool proof as possible.

Nowhere within the prior art is such a simplified improved device provided which allows for the manufacture of heavier windows and doors in larger sections without the sagging of the window and having reliable operating pivots incorporated in the assembly which both allows for the pivoting and sliding of the window by the user without the need for a multiplicity of user operated locks and latches.

Further in the manufacture of casement type windows there is found a large number of links and levers depending on the manufacturer of the window assembly. This renders the assembly costly to manufacture because of the assembly labour required. Further with protruding handles the window is prone to being damaged when shipped. One of the problems with known casement assemblies is that they are difficult to clean on the outside. U.S. Pat. No. 1,600,796 to Campbell addressed this concern. Further U.S. Pat. No. 1,341,366 endeavored to address this concern for casement windows. Final U.S. Pat. No. 5,289,656 attempted to improve on these previous structures. However the systems do not provide for ease of installation and variation in the window or door size which may be supported. Further the opening of the casement style windows provided to clean the outside of the window is insufficient to provide for all sizes of individuals and reaches.

It is therefore an object of this invention to overcome many of the deficiencies in the prior art stated above which allows for smooth and simple operation of a closure member which is capable of both sliding within a guide channel and tilting upon a pivot assembly thereof.

It is a further object of this invention to overcome many of the deficiencies in the prior art stated above which allows for smooth and simple operation and assembly of a casement style window which is capable of both pivoting to an open position, and allowing the pivoting end to slide within a guide channel to the opposite side of the frame within which the sash normally pivots for easy cleaning thereof.

It is a further object of the invention to provide casement windows of appropriate size and construction to replace existing double hung and/or tilt and slide windows.

It is a further object of the invention to provide a reliable carriage for use in relation to a guide channel disposed within a frame for a closure member and improvements therefore, whereby locking of the pivot when the closure member is rotated is unnecessary to maintain parallelism of the structure.

Further and other objects of this invention will become apparent to a man skilled in the art when considering the following summary of the invention and the more detailed description of the preferred embodiments illustrated herein.

SUMMARY OF THE INVENTION

According to one aspect of the invention, there is provided a closure assembly having two ends comprising a first and second track disposed proximate each end of the assembly respectively, and a slidable and pivotable closure member, the closure member including framing sections there for and being engaged with the first and second tracks proximate first and second pivots adjacent the pivotable end of the member, the first and second pivots being interconnected by a multiple segment shaft disposed within framing sections of said closure member, (for example the shaft including at least two portions and preferably being telescoping), the shaft providing for accurate installation, retention, removal, adjustment and alignment of the first and second pivots within the first and second tracks in a substantially parallel line with respect to one another and for pivotally supporting the closure member which may be safely and securely pivoted away from the closure assembly, whereby the first and second interconnected pivots are adapted to remain engaged with the first and second tracks while supporting the closure member both when it is pivoted away from the closure assembly and when it is slidable relative to the track.

In one embodiment the closure assembly may further comprise a carrier traveling within said each of said first and second tracks and having interconnected first and second portions, disposed within each of said first and second tracks the first portion being engaged with the first and second pivots of the closure member and the second portion being spaced from the first portion within each of the first and second tracks the carrier to further assist sliding movement and pivoting movement of the closure member and preferably wherein the distance between said interconnected first and second portions is adjustable.

Preferably the first portion of the carrier traveling within each of said first and second tracks further comprises an opening within which the first or second pivots are disposed to cooperate with the first portion. Preferably the first and second pivots portions may further comprise a rotatable pinion disposed therewith for facilitating the movement of the carrier relative to each of the first and second tracks preferably in cooperation with a rack disposed with each of said first and second tracks. Preferably the closure member may further comprise latching means for latching the closure member in relation to the carrier to prevent pivoting of the closure member when the closure member is slidable relative to the tracks, and preferably wherein the latching means is a central locking member disposed with the framing sections of the closure member.

According to another aspect of the invention, there is provided a pivoting and sliding closure assembly comprising:

i) an opening extending within a frame ii) the frame having two ends and having disposed therein or attached thereto proximate each track portions extending in a substantially parallel direction to the extensions of said ends of said frame;

iii) at least one closure member having framing portions and two ends and being slidable within said track portions and pivotable proximate at least one end thereof and latchable in the track portions proximate the other end thereof;

iv) each of said track portions having disposed therein at least two pivot shoes adjacent the pivoting end of the closure member, each shoe being substantially compatibly shaped with the track portions and having a top and bottom, (preferably having rolling means disposed adjacent the bottom thereof for assisting the movement of the pivot shoe), each shoe having disposed therein adjacent the pivoting end of the at least one closure member an opening extending from the top toward the bottom of the shoe wherein pivot means are disposed, said pivot means provided with said pivot shoes being interconnected by a multiple segment shaft disposed within said framing portions of said at least one closure member, (for example the shaft including at least two portions and preferably being telescoping) the shaft providing, for accurate installation, retention, removal, adjustment and alignment of the first and second pivots within the track portions in a substantially parallel line for pivotally supporting the at least one closure member for safe and secure pivoting away from the closure assembly;

v) the at least one closure member having latching means provided therewith for latching the at least one closure member in relation to the track portions to prevent the at least one closure member from pivoting upon the pivot means when the at least one closure member remains slidable with said track portions; and preferably the latching means is a central locking member disposed with the framing portions of the at least one closure member.

vi) the at least one closure member being braced by the multiple segment shaft interconnecting the pivot means disposed with each track portions, the substantially parallel alignment of the pivot means provided by the multiple segment shaft preventing the pivot means from misaligning and/or disengaging from the relevant track portions when the at least one closure member is rotated to an open position and/or when it remains slidable within said track. Preferably the pivot means may further comprise a rotatable pinion for facilitating the movement thereof relative to the track preferably in cooperation with a rack disposed with said track.

Preferably said closure member may further comprise a window sash being a casement, double hung, or tilt and slide installation or, a door or a patio door.

According to another aspect of the invention, there is provided a pivoting and sliding closure assembly comprising:

i) an opening extending within a peripheral frame said peripheral frame including a header portion, a sill portion and two vertically extending jamb portions;

ii) the sill and header portions or the two jamb portions having disposed therein or attached thereto track portions extending in a substantially parallel direction to the extensions of said peripheral frame portions;

iii) at least one closure member having two ends and framing portions and being slidable within said track portions and pivotable proximate at least one end thereof and latchable in the track portions proximate the other end thereof;

iv) each of each track portions having disposed therein adjacent the pivoting end of the at least one closure member at least two pivot shoes, each pivot shoe being substantially compatibly shaped with the track portions and having a top and bottom (preferably having rolling means disposed therein proximate the bottom thereof for assisting the movement of the pivot shoe), each pivot shoe having disposed therein adjacent the pivoting end of the at least one closure member an opening extending from the top toward the bottom of the shoe wherein pivot means are disposed, said pivot means being interconnected by a multiple segment shaft disposed within the said framing portions of said at least one closure member, (for example the shaft including at least two portions and preferably being telescoping), the shaft providing for accurate installation, retention, removal, adjustment and alignment of the pivot means in a substantially parallel line for pivotally supporting the at least one closure member for safe and secure pivoting away from the at least one closure assembly;

v) the at least one closure member having latching means provided therewith for latching the at least one closure member in relation to the track portions to prevent the at least one closure member from pivoting upon its pivot means when the at least one closure member remains slidable with said track portions; and preferably wherein the latching means is a central locking member disposed with the closure member;

vi) the at least one closure member being braced by the multiple segment shaft which provides for accurate installation, retention, removal, adjustment and alignment of the interconnected pivot means disposed with each track, portion the substantially parallel line of the pivot means provided by the multiple segment shaft preventing the at least one closure member from misaligning and/or disengaging from the relevant track portion when rotated to an open position or when the at least one closure member remains slidable within said track portions. In one embodiment said at least one closure member is a window sash being a casement, double hung, or tilt and slide installation. In another embodiment said closure member is a door and preferably a patio door. Preferably the pivot means may further comprise a rotatable pinion for facilitating the movement of the at least one closure member relative to the track, preferably the pinion cooperating with a rack disposed with said track portions.

According to yet another aspect of the invention there is provided for use in a pivoting and sliding closure assembly, a closure member slidable within a guiding channel and pivotable therefrom, the closure member having a substantially rectangular frame having a top and bottom, and having engaged at its top and bottom, proximate one end of the closure member, pivots for engaging a first and second shoe, and having disposed at the other end of the closure member proximate its top and bottom, user accessible means for engaging the guiding channel (preferably wherein said user accessible means is a central lock);

said shoes being slidable in said guiding channel and comprising a substantially rectangular body having a top and bottom (preferably made from thermoplastic material) and preferably having disposed proximate the bottom thereof at least one roller or wheel), said shoes having disposed therewith pivot means (preferably the pivot means may further comprise a rotatable pinion for facilitating the movement of the shoes relative to the track preferably in cooperation with a rack disposed with said track) the rotatable pinion for engagement engage with the shoes, said pivot means being interconnected by a multiple segment shaft disposed within said frame (for example at least two portions and preferably telescoping), which provides for accurate installation, retention, removal, adjustment and alignment of the pivot means with said track portions, each shoe having an opening for said pivot means, the opening extending from proximate the top towards the bottom of said shoe, whereby when the closure member pivots upon the pivot means away from the guide channel it is braced from misalignment by the multiple segment shaft for (for and by the interconnected pivot means disposed with each channel, the substantially parallel line of the pivots being provided by the multiple segment shaft when the closure member is rotated to an open position or when it remains slidable within said track. In one embodiment said closure member is a window sash being a casement, double hung, or tilt and slide installation. In another embodiment said closure member is a door and preferably a patio door.

According to another aspect of the invention, there is provided a closure assembly comprising a track and a slidable and pivotable closure member, the closure member being engaged with the track proximate first and second pivots adjacent a pivotable end of the closure member, the first and second pivots being connected by a cable system connecting the upper and lower pivots to move in and be maintained in substantially parallel positions at all times to retain and align the first and second pivots in a substantially parallel line for pivotally supporting the closure member so that it may be safely and securely pivoted away from the closure assembly, whereby the first and second connected pivots are adapted to remain engaged with the track while supporting the closure member both when it is pivoted away from the closure assembly and when it is slidable relative to the track.

According to another aspect of the invention, there is provided hardware for a closure assembly having a track and a slidable and pivotable closure member, the closure member having framing portions and being engaged with the track proximate first and second pivots adjacent the pivotable end of the member, the hardware comprising the first and second pivots being interconnected by a multiple segment shaft disposed within the framing portions of said closure member in use, (for example at least two portions and preferably telescoping), the shaft providing for accurate installation, retention, removal, adjustment and alignment of the first and second pivots in a substantially parallel line for pivotally supporting the closure member so that it may be safely and securely pivoted away from the closure assembly, whereby the first and second interconnected pivots are adapted in use to remain engaged with the track while supporting the closure member both when it is pivoted away from the closure assembly and when it is slidable relative to the track.

According to another aspect of the invention, there is provided hardware for a closure assembly having a track and a slidable and pivotable closure member, the closure member being engaged with the track proximate first and second pivots adjacent the pivotable end of the member, the hardware comprising the first and second pivots being connected by a cable system connecting the upper and lower pivots to move in and be maintained in substantially parallel positions at all times to retain and align the first and second pivots in a substantially parallel line for pivotally supporting the closure member so that it may be safely and securely pivoted away from the closure assembly, whereby the first and second connected pivots are adapted to remain engaged with the track while supporting the closure member both when it is pivoted away from the closure assembly and when it is slidable relative to the track.

According to yet another aspect of the invention there is provided a resiliently biased lock and handle which normally locks the shaft of any of the aforementioned embodiments in operation until the handle is operated by a user wherein the lock unlocks the shaft and allows the shaft to rotate, and when the handle is released again said lock locks the shaft, allowing for continuous locking of the window at any position.

In an embodiment of the aforementioned invention in the preceding paragraphs when embodied in a tilt and slide or double hung window the inside rack portions provided within the track of the assembly, which extend the full width of the frame, curve towards the stationary closed position for the window assembly and provide a closed window assembly in which both sashes are oriented in a straight line.

In an embodiment of the aforementioned invention in the preceding paragraphs when embodied in a tilt and slide, casement or double hung window a retractable screen is provided disposed within the or jamb of the assembly which accumulates on and pays out from a spring biased roll disposed within said header or jamb, the screen being retractable for egress or cleaning purposes, and available as desired by providing a detent on the opposite jamb engageable with the screen when in its operatable position.

In an embodiment of the aforementioned invention in the preceding paragraphs when embodied in a casement window a link having two ends is fastened at one end proximate the center of the bottom of the window sash and proximate the other end of the link adjacent the end of the sill of the window frame to allow for full operation of the casement window from a fully closed to a fully open position and the movement of the pivoting end of the window towards the opposite end so as to allow full access to the outside of the window and the easy cleaning thereof. In another embodiment the link is removable to allow total reversing of the window for cleaning and/or removal purposes.

In another embodiment of the invention the rack disposed with the track is made from aluminum and formed in three separate steps so as to minimize the amount of vertical creeping of the rack when formed. The rack also acts as a liner to distribute the load of the sash and minimize distortion of the vinyl preferred extrusions.

According to the following improvements of the invention reference is made to the previous structures described substantially in the first eleven paragraphs of this disclosure. Whenever reference is made below to the structures or inventions of the "above mentioned paragraphs" or "described above" or the like its is intended to refer the reader primarily from the paragraphs for the following improvements to the summary of inventions above and to improvements to the structures described therein as defined by the sections immediately following this paragraph.

According to yet another aspect of the invention there is provided a closure assembly comprising a track and a slidable and pivotable closure member, the closure member being engaged with the track proximate first and second pivots adjacent the pivotable end of the member, the first and second pivots being interconnected by a multiple segment shaft (for example at least two portions) (for example telescoping) which provides for accurate installation, retention, removal, adjustment and alignment of the first and second pivots in a substantially parallel line for pivotally supporting the closure member so that it may be safely and securely pivoted away from the closure assembly, whereby the first and second interconnected pivots are adapted to remain engaged with the track while supporting the closure member both when it is pivoted away from the closure assembly and when it is slidable relative to the track. Preferably the first and second pivot portions further comprise a rotatable pinion disposed therewith for facilitating the movement of the carrier relative to the track. In a preferred embodiment wherein the rotatable pinion moves in cooperation with a rack disposed with said track. The closure assembly may further comprise a window sash being a casement, double hung, or tilt and slide installation or, a door or a patio door.

According to yet another aspect of the invention there is provided a pivoting and sliding closure assembly comprising:

i) an opening extending within a frame ii) the frame having disposed therein or attached thereto a first and second track portion extending in a substantially parallel direction to the extensions of said frame portions;

iii) at least one closure member slidable within said track portions and pivotable proximate at least one end thereof and latchable in the tracks at the other end thereof;

iv) each track portions having disposed therein a pivot shoe adjacent the pivoting end of the closure member, said shoe being substantially compatibly shaped with the track and having a top and bottom, (preferably having rolling means disposed therein for assisting the movement of the pivot shoe in the track), the shoe having disposed therein an opening extending from the top toward the bottom of the shoe wherein pivot means are disposed, said pivot means of said shoe disposed with said first track portion being interconnected with the pivot means of the shoe in the second track portion by a multiple segment shaft (for example at least two portions) (for example telescoping) which provides for accurate installation, retention, removal, adjustment and alignment of the first and second pivots in a substantially parallel line for pivotally supporting the closure member for safe and secure pivoting away from the closure assembly;

v) the closure member having latching means provided therewith for latching the at least one closure member in relation to the track to prevent the closure member from pivoting upon its pivot means when the closure member remains slidable with said track vi) the at least one closure member being braced from sagging by the multiple segment shaft interconnecting the pivots disposed with the pivot shoe of each track, the substantially parallel line of the pivots provided by the a multiple segment shaft preventing the pivots from sagging and/or disengaging from the relevant track when the at least one closure member is rotated to an open position and/or when it remains slidable within said track. Preferably the pivots further comprise a rotatable pinion for facilitating the movement of the shoe or carrier relative to the track. In one embodiment the pinion moves in cooperation with a rack disposed with said track. The closure assembly may further comprise a window sash being a casement, double hung, or tilt and slide installation or, a door or a patio door.

According to still yet another embodiment of the invention there is provided a pivoting and sliding closure assembly comprising:

i) an opening extending within a peripheral frame said peripheral frame including a header portion, a sill portion and two vertically extending jamb portions;

ii) the sill and header portions or the two jamb portions having disposed therein or attached thereto first and second track portions extending in a substantially parallel direction to the extensions of said peripheral frame portions;

iii) at least one closure member slidable within said track portions and pivotable at least one end thereof and latchable in the track at the other end thereof;

iv) each track portions having disposed therein a pivot shoe adjacent the pivoting end of the closure member, said shoe being substantially compatibly shaped with the track and having a top and bottom, (preferably having rolling means disposed therein for assisting the movement of the pivot shoe), said shoe having disposed therein an opening extending from proximate the top toward the bottom of the carrier wherein pivot means are disposed, said pivot means for said shoes disposed within said first and second tracks being interconnected by a multiple segment shaft (for example at least two portions) (for example telescoping) which provides for accurate installation, retention, removal, adjustment and alignment of the pivots in a substantially parallel line for pivotally supporting the closure member for safe and secure pivoting away from the closure assembly;

v) the closure member having latching means provided therewith for latching the at least one closure member in relation to the track to prevent the closure member from pivoting upon its pivot means when the closure member remains slidable with said track;

vi) the at least one closure member being braced from sagging by the multiple segment shaft (for example at least two portions) (for example telescoping) which provides for accurate installation, retention, removal, adjustment and alignment interconnecting the pivot means disposed with each track, the substantially parallel line of the pivots provided by the multiple segment shaft preventing the closure member from sagging and/or disengaging from the relevant track when rotated to an open position or when it remains slidable within said track. In one embodiment said closure member is a window sash being a casement installation. In another embodiment the closure member is a window sash being a double hung, or tilt and slide installation. Preferably the pivots further comprise a rotatable pinion for facilitating the movement of the carrier relative to the track, and in one embodiment wherein said pinions move in cooperation with a rack disposed with said track.

According to yet another aspect of the invention there is provided for use in a pivoting and sliding closure assembly, a closure member slidable within a guiding channel and pivotable therefrom, the closure member having a substantially rectangular frame having a top and bottom, and having engaged at its top and bottom proximate one end pivots for engaging a first and second shoe, and having disposed at the other end thereof proximate its top and bottom user accessible means for engaging the guiding channel (preferably wherein said user accessible means is a central lock); said shoes being slidable in said guiding channel and comprising a substantially rectangular body having a top and bottom (preferably made from thermoplastic material) and preferably having disposed proximate the bottom thereof at least one roller or wheel), said shoes having disposed therewith pivot means (preferably the pivot means may further comprise a rotatable pinion for facilitating the movement of the shoe relative to a track provided with said guiding channel and preferably in cooperation with a rack disposed with said track) to engage with the shoes, said pivot means being interconnected by a multiple segment shaft (for example at least two portions) (for example telescoping) which provides for accurate installation, retention, removal, adjustment and alignment of the pivot means, each shoe having an opening for said pivot means, the opening extending from proximate the top towards the bottom of said shoe, whereby the closure member upon the pivot means pivoting away from the guide channel is braced from sagging by the a multiple segment shaft (for example at least two portions) (for example telescoping) which provides for accurate installation, retention, removal, adjustment and alignment and interconnecting of the pivot means disposed with each channel, the substantially parallel line of the pivots provided by the multiple segment shaft (for example at least two portions) (for example telescoping) preventing the closure member from sagging and/or disengaging from the relevant track when rotated to an open position or when it remains slidable within said track. In one embodiment the pivot means further comprises a rotatable pinion for facilitating the movement of the carrier relative to the track and preferably wherein said pinion moves in cooperation with a rack disposed with said track.

According to yet another aspect of the invention there is provided hardware for a closure assembly having a track and a slidable and pivotable closure member, the closure member being engaged with the track proximate first and second pivots adjacent the pivotable end of the member, the hardware comprising the first and second pivots being interconnected by a multiple segment shaft (for example at least two portions) (for example telescoping) which provides for accurate installation, retention, removal, adjustment and alignment of the first and second pivots in a substantially parallel line for pivotally supporting the closure member so that it may be safely and securely pivoted away from the closure assembly, whereby the first and second interconnected pivots are adapted in use to remain engaged with the track while supporting the closure member both when it is pivoted away from the closure assembly and when it is slidable relative to the track.

Preferably the hardware may be embodied in a casement window wherein a link having two ends is fastened at one end proximate the center of the bottom of the window sash and proximate the other end adjacent the end of the sill of the window frame to allow for full operation of the casement window from a fully closed to a fully open position and the movement of the pivoting end of the window towards the opposite end so as to allow full access to the outside of the window and the easy cleaning thereof. In another embodiment the link is removable to allow total reversing of the window for cleaning and/or removal purposes.

In other embodiments the inventions described in the last six paragraphs may be embodied in a tilt and slide, casement or double hung window wherein a retractable screen is provided disposed within the jamb of the assembly which accumulates on and pays out from a spring biased roll disposed within said jamb, the screen being retractable for egress or cleaning purposes, and available as desired by providing a detent on the opposite jamb engageable with the screen when in its extended position.

According to another aspect of the invention, the inventions described in the last six paragraphs the rack disposed with the track is made from aluminum and formed in three separate steps so as to minimize the amount of vertical creeping of the rack when formed and preferably wherein the rack also acts as a liner to distribute the load of the sash and minimize distortion of the vinyl track.

In a preferred embodiment of the invention described above, the frame portions, for example the headers, vertical jambs or sills are formed separately from the track. The track includes an integral rack portion proximate one side thereof, said rack portion including a plurality of teeth extending substantially from end to end of said track, and for engagement with the rotatable pinion of said carrier which facilitates the movement of the carrier relative to the track. The track is fixed in position relative to the headers, sills and/or jambs by the provision of two supplementary portions. The first supplementary portion is a block which has two ends, a top and a bottom, the block having disposed in use proximate the top thereof at least one opening to receive fasteners, the at least one opening extend to the bottom of the block. The fasteners are for engagement with the frame portion and preferably wooden base portions disposed within the frame and are provided to lock the first block in position in relation to the end of the track remote the pivoting end of the closure member, and thereby fixing the track in position. The first block has disposed therewith an adjuster moveable in relation to said block in a direction extending towards said track and preferably rotatable, said adjuster being engageable with a second supplementary portion, and preferably a nut portion having track shaped abutting portions proximate one side thereof, and for engagement with said track. The second portion has elements provided therewith which are engageable with said adjuster and said track, said adjuster being moveable in position to move the track abutting portions in relation to the rack provided with the track, wherein movement of said adjuster will move said second portion and preferably said nut in relation to said track and said rack in a direction toward and away from the block thereby adjusting the position of said track in relation to said frame portions and thereat fixing said rack in position. The main advantage of providing such an adjustment for the track is to establish and allow for the alignment or adjustment of the closure member and to maintain the parallelism of the carrier in relation to for example both a bottom and a top track in the case of a tilt and slide or casement window, or the left and right side in the case of a double hung widow, so that the pivots remain substantially parallel and square to one another. Aluminum is preferably used for the track since it is able to take the weight of the window more readily than vinyl or other plastic material. The track may be formed from the previously mentioned three separate steps so as to minimize the amount of vertical creeping of the rack when formed. In a preferred embodiment, the adjuster is a rotatable cap screw preferably having an opening therein for an alien key, and which is contained within an opening proximate one end of the first block remote the track and wherein said cap screw is threaded into the second block or preferred nut, wherein rotation of the screw in relation to the fixed block, for example by an allen key, will cause the second block or preferred nut to move fore and aft in relation to the track and provide for a final adjustment or readjustment of the track in relation to the carrier in both the top and bottom or side tracks of the window system depending on what window system is used. Preferably the block is manufactured from aluminum, and the adjuster nut is manufactured from Delrin (™). In another embodiment, the block and nut are manufactured from fiber filled nylon. In a preferred embodiment of the invention, both the first block and second nut further comprise a detent, for example a right angled triangle notch proximate the top thereof for engagement with a lock in use for a pivoting window, the lock being compatible with the detent. The blocks therefore provide a reinforced portion of the window frame against which the lock may abut in use. Otherwise the lock would engage only a vinyl flange of the sill or header for example, and the window load may in time tear or distort said flange to render it useless.

In another a preferred embodiment of the invention, the rack formed integral with the track further comprises an upstanding flange disposed proximate one side of the track wherein the rack is disposed having a plurality of teeth for engagement with the pinion gear of the carrier or shoe. Preferably the rack is formed by a three-step process to minimize the amount of vertical creeping of the preferred aluminum material. Preferably the carrier is a pivot shoe provided for engagement with said rack and track and further comprising a carrier having a top and a bottom, the carrier having disposed proximate the bottom thereof means, and preferably slots, for retaining rollers, and the rollers in use thereof for providing the smooth movement of the shoe within the track, preferably the rollers being engaged with a predetermined channel formed in said track, said carrier also having an opening disposed proximate the top thereof wherein a pivot gear is disposed, said pivot gear having a top and a bottom and having disposed primate the top thereof a pivot engaging portion for engaging the pivot of a closure member such as a window sash, said pivot gear having disposed proximate the bottom thereof an anti-thrusting wheel portion for engagement with a shoulder provided proximate each side of the track channel, for example to engage the shoulder of the channel as a result of thrust which may be caused by the wind load on the closure member and the normal thrust caused by meshing of gears, the anti-thrusting wheel preferably being of a predetermined diameter of a dimension less than the channel of the track so as to minimize drag in the track, said pivot gear having disposed intermediate said pivot engaging portion and said anti-thrust wheel portion a pinion gear portion for engaging the rack, wherein the previously described closure member and specifically the pivots thereof engages with the carrier portion, wherein movement of said carrier portion will affect rotation of said pinion in relation to said track and the smooth movement of the carrier along the track maintaining the parallelism, of said upper and lower pinions for the case of both a tilt and slide and casement window, and said left and right pinions in the case of double hung windows. Preferably said carrier portion is made from Delrin(™), and said pivot gear portion is made from nylon. The anti-thrust wheel portion is provided to engage the shoulders provided adjacent the recess of the track to accommodate any thrusting of the pinion which might occur, due to wind loading or the like and the rotation of the gears, and to maintain the pinion substantially central in relation to the carrier at all times. The rollers provided proximate the bottom of said carrier are to ensure smooth movement of the carrier in relation to the track. Preferably the rollers are made from metal.

In another preferred embodiment of the invention, the vinyl profile forming the closure member (for example a sash profile) may further comprise a cover disposed on the side of the profile opposite the glass, which cover extends substantially along the length of the profile and which has disposed proximate the sides thereof two flanges for locking engagement underneath flanges provided with the profile, said profile further including a space defined within said profile enclosed by said plastic cover, preferably said space containing in use a closed cell foam or the like, for example a closed cell caulking foam, which is compressible, said plastic cover having disposed proximate the bottom thereof intermediate said flanges spring-loaded members, for example fingers, engageable with said foam, and preferably when installed slightly loading said foam to create a spring biased resistance of the foam against the cover further locking the cover in position with the profile. Preferably the cover is made from thermoplastic or thermoset material and when installed extends down from said profile toward the space defined within said track portion between the flanges thereof. The cover provides a locking flexible seal throughout the length of the closure member with the exception of the area adjacent the carrier portion located proximate the pivoting end of said closure member. In various embodiments of the invention, the cover may be embodied with a casement window, a tilt and slide window and a double-hung window. The use of a closed cell foam such as caulking foam or the like in the space within the profile provides resilience and strength to the cover along the length of the profile and therefore allows for the foam and cover together to provide a surface upon which the closure member may travel while the carrier moves in the track. Also, the cover behaves as a seal for the profile and in use indirectly for the track to keep dust and other undesirable elements out of the track and out of the profile, and assists to prevent passing cold air.

According to yet another aspect of the invention and in a preferred embodiment thereof, there is provided a release mechanism for locking a closure member from pivoting movement in a closure assembly, the closure member being carried by the carrier described in the above paragraphs, said release mechanism further comprising operating means disposed with the closure member, and preferably with the window sash elements, said operating means may be provided intermediate the lockable ends of the closure member, and accessible to the user. For example, when the closure member is provided within a tilt and slide window, the operating means will generally be disposed in a vertical plane provided with a vertical sash element so that the operating member when operated will cause the locking and unlocking of the tilt and slide window and allow free movement thereof. When the operating means is provided in a double-hung window, the operating means may be a handle disposed in a horizontal plane and being operable by the user to and from a locked and released position to allow movement of the double-hung window, for example, pivoting thereof to access the exterior pane surface and provide cleaning thereof. In another embodiment when the closure member is a casement window sash, the operating member may be disposed in a substantially vertical direction and is operable by the user to and from a locked and unlocked position, the operating means being user operable to and from a first locked position and a second unlocked position. In all cases, bi-directional locking means are provided with the sash profile and being moveable by the operation of said operating means to cause locking portions engaged with said bi-directional locking means to move in and out of engagement with track portions (and in one embodiment the previously described block and nut portions) disposed proximate at least two opposed locations of said closure assembly, and when the window is a casement window further locking action resulting from the engagement of a third portion in and out of locking engagement with a locking detent provided adjacent the jamb wherein the window sash is contained. The operation of the operating means in a first direction causes the locking portion to move out of engagement with, the track portions or the detent provided with the track portion, and when a casement window is in use, the locking detent adjacent to the jamb, to therefore allow pivoting movement of the closure member. Movement of the operating means in the second direction causes the locking portions to move into engagement with the track portions or the detent provided with the track portion and therefore prevent the pivoting movement of the closure member. In a preferred embodiment, the release mechanism for locking a closure member includes a handle portion which has provided proximate one end thereof a handle and proximate the other end thereof a pinion, said pinion being engageable with a rack portion proximate one side thereof and a second rack portion proximate the other side thereof, said rack portions being engaged with locking portions which extend to the track or detent provided with the track in use to latch and unlatch the closure assembly, for example the window. When a casement window embodies the release mechanism, the pinion portion also engages one of the rack portions which further engages a second pinion rotatable by the motion of the second rack, the second pinion being engageable with a latch portion including a pinion sector provided therewith, causing the rotation of the latch portion into and out of engagement with a detent portion provided proximate the jamb of a casement window assembly, said single handle therefore operating both the locks proximate the track portion and when a casement window is used the lock proximate the jamb portion. Applicant refers the reader to U.S. patent application Ser. 08/171,750 filed Dec. 22, 1993, by the proprietor of the Assignee for this Patent Application, specifically referring to FIG. 33 and a description a bi-directional operating or release mechanism, the contents thereof which is hereby incorporated by reference, in relation to the structure and operation of the bi-directional release mechanism.

According to yet another aspect of the invention of the casement window assembly described above, there is provided a casement window assembly further comprising a jamb portion located proximate the pivoting end of the casement window preferably said window including a clip in flexible cover for the sash, said jamb portion including a pocket portion extending substantially towards the casement window sash and providing a pocket for the pivoting end of the casement window wherein said carrier is disposed in use, thereby providing a recess or pocket within which the closed casement window proximate the pivoting end thereof is located and when a cover is provided with the sash to snap fit those with to improve the seal and weatherproofing of the casement window, said pinion upon pivoting of the casement window causing the rotation of said gears and the sliding motion of the pivoting end of the window away from the jamb pocket thereof to prevent binding of the pivoting end with the pocket extending with the jamb portion, thereby providing the sealing improvements to the casement window, wherein when the casement window is moved to the closed position, the pivoting end will move back into the pocket provided.

According to yet another aspect of the invention, there is provided a conversion kit for a frame opening to convert a, a double-hung window or a tilt and slide window to a casement window assembly, said conversion kit comprising framing portions for containing track portions engageable with the framing portions of the window frame section (for example header and sill, or two vertical jamb members), said track portion, preferably being made from aluminum, and including a rack portion proximate at least one side thereof, a casement window sash having a carrier and interconnecting pivot assembly provided therewith substantially as described above, and for insertion and operation with respect to the track portions of the frame, wherein said casement window fully fills the space occupied by the previously installed double-hung or tilt and slide window, and the jamb, sill, and header portions are installed in the space provided. Typically, casement windows known today are narrow and of standard sizes. The known prior art hardware therefore provided prohibits the installation of a casement window where double hung or tilt and slide windows were previously installed. The present invention however opens up the possibility of changing window types as the consumer desires. Therefore, the existing window assembly is stripped out down to the wooden frame section.

The installer installs the vinyl header sill and jamb section to the wooden frame chambers. The tracks are then installed, and preferably using the block and nut portions previously described, the block portion being screwed into the vinyl sill and header and the wooden frame members. The hardware with the carriers and interconnected pivots are then installed with the sash and squared in position. The window sash includes in the preferred embodiment the central locking handle and racks and pinions contained in the sash adjacent the opening end and contains the interconnecting shaft for the pivots. The casement window therefore replaces the previous window installation. Preferably a screen is provided with the vertical jamb on the inside of the casement window which can be extended and retracted in position to cover a window opening when the casement is open and to retract when the window is closed.

According to yet another aspect of the invention, there is provided a method of assembling a window sash, said window sash being used with a casement, tilt and slide or double-hung window and being interchangeable and of standard construction with respect to the various window sashes required, said method comprising:

(1) forming the sash element according to the standard profile, said standard profile comprising a generally rectangular "T" shaped member having a center reinforcement comprising an inner and an outer wall and a hollow therebetween and having extending from the ends of these inner and outer walls proximate both the top and bottom thereof substantially "T" shaped members extending substantially horizontally in profile extending along the length of the sash element also having inner and outer walls and a hollow therebetween, the sash element having provided proximate one end thereof flanges extending inwardly toward one another for receiving a dust cover or auxiliary member fastening thereto and having located proximate the other end thereof a glass engaging recess, the cover or auxiliary member being fastened to the sash profile and being variable from window style to window style, (2) inserting the glass within the glass receiving portion of the sash elements and, (3) connecting said sash elements with interior corner connectors having a quick fastening feature which are inserted within the central opening of the sash profiles provided and provide a one-way friction fit for connecting the comers proximate the interior of the sash element, wherein said sash may be used for a tilt and slide window, double-hung window, or casement windows.

A method therefore of assembling the window is provided wherein, the sash components are assembled around a typical sealed double pane window glass by the quick fastening feature of the corner locking portions which are inserted within the opening of the sash profiles provided and provide one-way friction fit. The closed cell caulking is therefore inserted within the top and bottom of the sash assembled and these portions are covered by track covers by the compression of the closed cell foam and the engagement of the tabs of the track cover with the tabs of the sash profile. The hardware is then installed along the vertical portions of the sash within the openings thereof opposite the glass which is then covered by a sash cover portion provided. The hardware located proximate the pivoting end is therefore installed on the carrier portions and inserted within the track portion within the sill and header, for example of a window assembly. The window is therefore closed in position with the sash covers or track covers located proximate the sill and header snapping into the frame and closing any path for air to enter the window and pass the primary seals provided. The track covers also provide blockage of light, air and the friction fit of the sash into the track portions. By providing a track cover along the track remote the pivoting end of the window, this track cover may be used as support as well for the window assembly.

According to another aspect of the invention of the casement window described above, the casement window may further comprise a straight line window frame and assembly having a center mullion wherein casement windows are disposed on each side of the mullion with the operating portions including the carrier and interconnected pivot assembly and shafts thereof described above, thereby providing a double-casement window, wherein said casement windows pivot in substantially opposite directions, and provide a straightline window when in the closed position. According to yet another aspect of the invention, there is provided a cover for a tilt and slide window track, the track comprising a first half and a second half interconnected to provide a continuous track for the window, the first half being disposed below the closed window, and the second half being provided as a continuation of the first half, the second half including the track cover portion which clips into position to engage the flange portions of the sill of the window and thereby provide support for the window as it glides along the second half of the track.

DETAILED DESCRIPTION OF THE PREFERRED EMBODIMENTS

Figure 1:
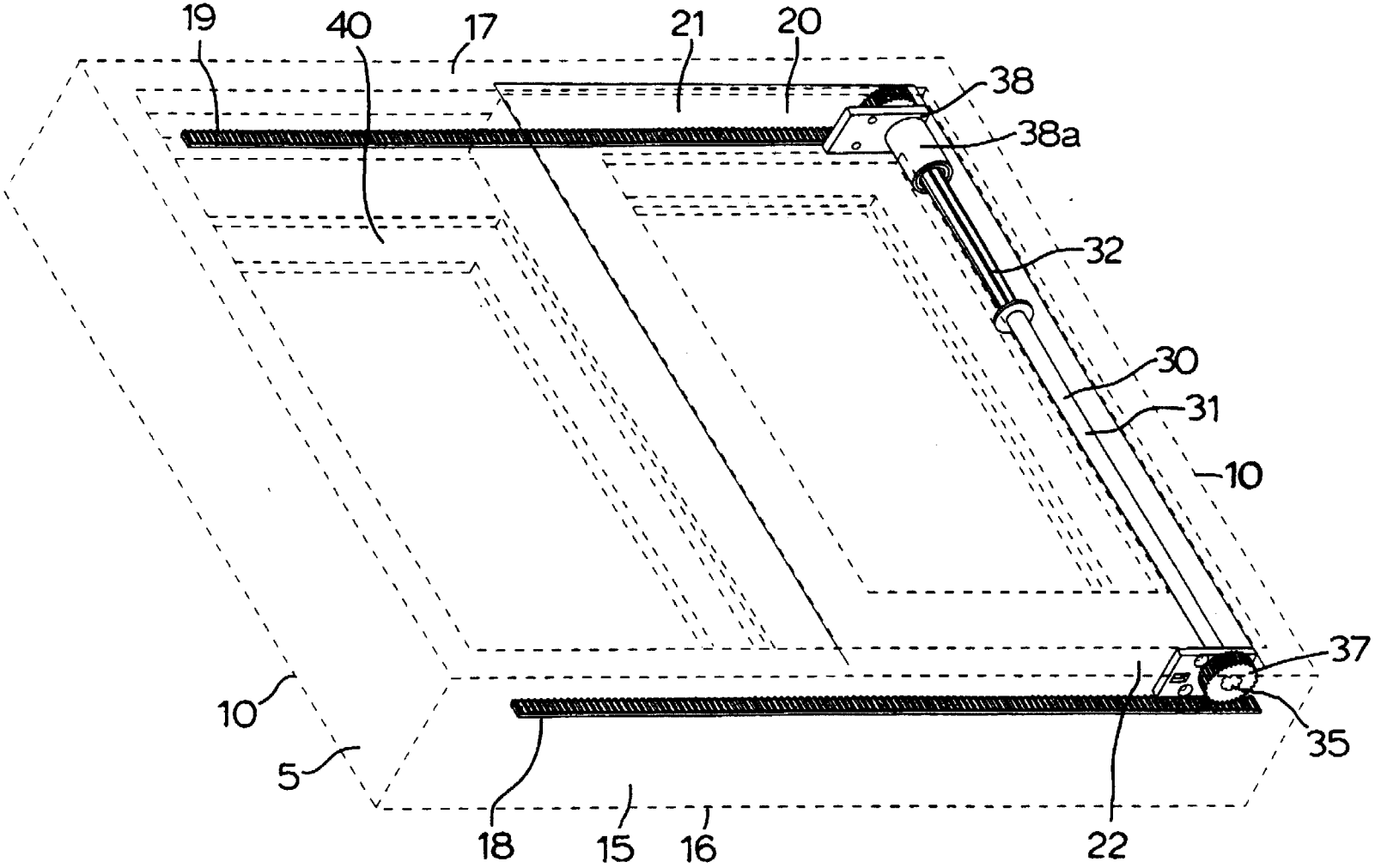
FIG. 1 is a schematic perspective view of a tilt and slide window, wherein said windows move in a horizontal direction, illustrated in a preferred embodiment of the invention.
Figure 2:
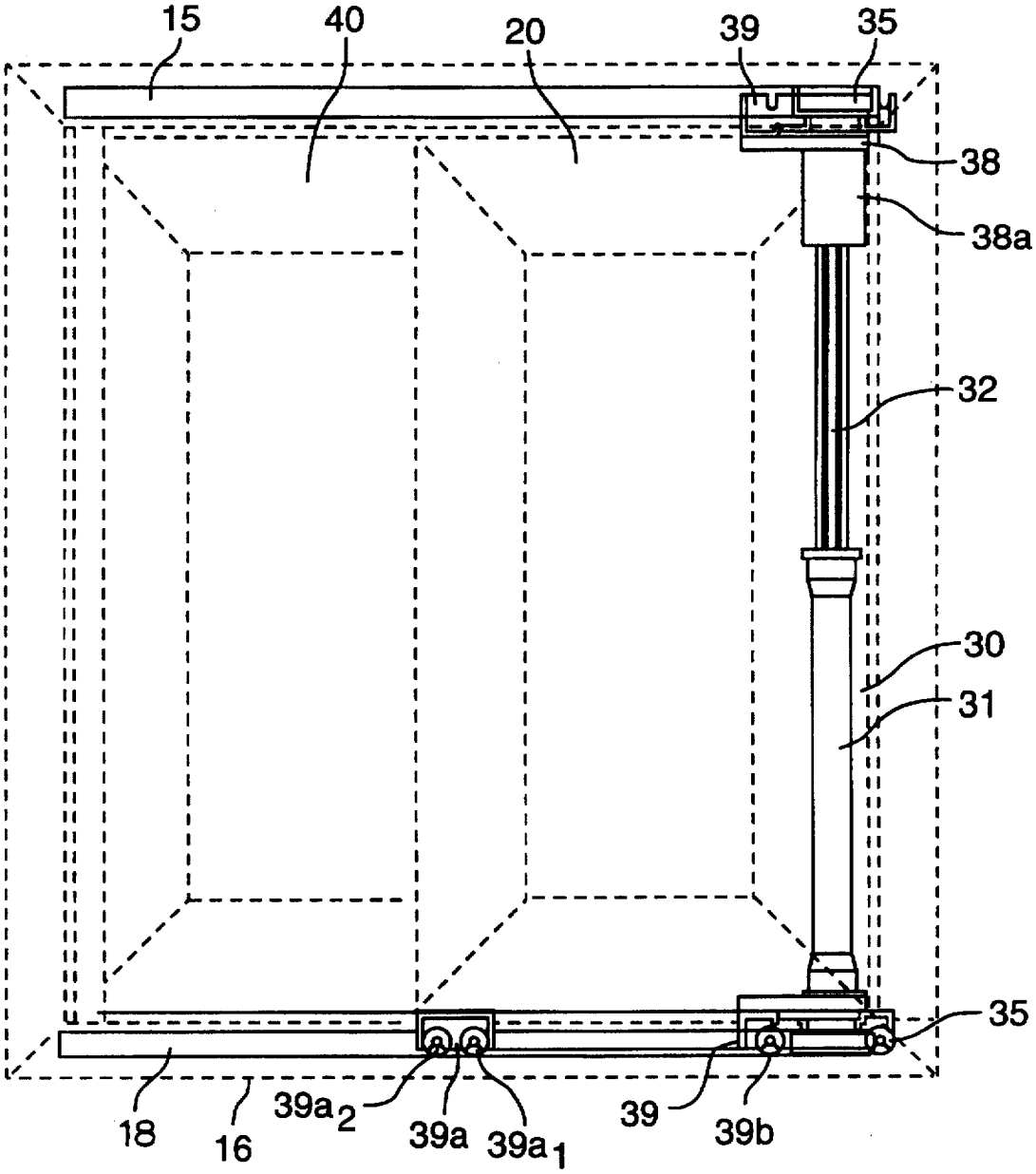
FIG. 2 is a front view of the window of FIG. 1.
Figure 2A:
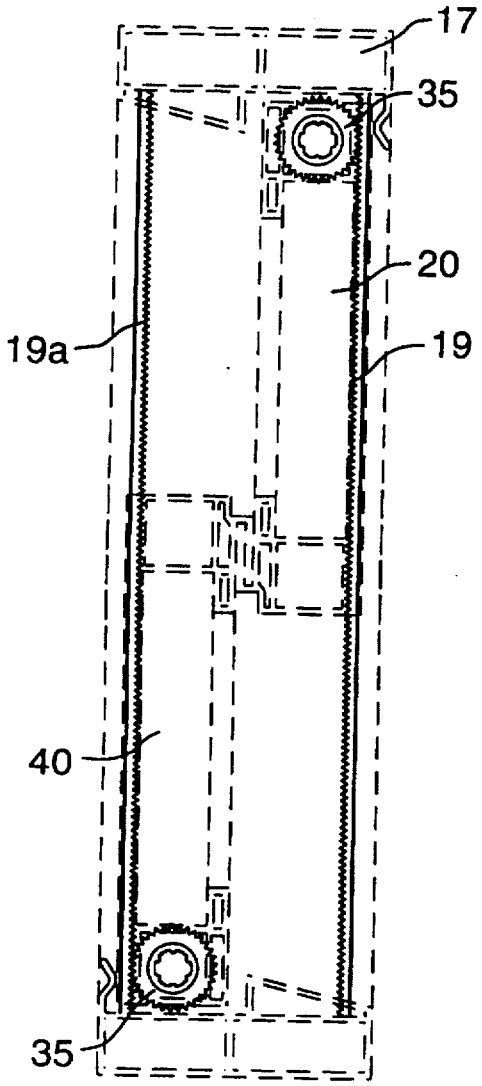
FIG. 2*a* is a top view of the window of FIG. 1.
Figure 2B:
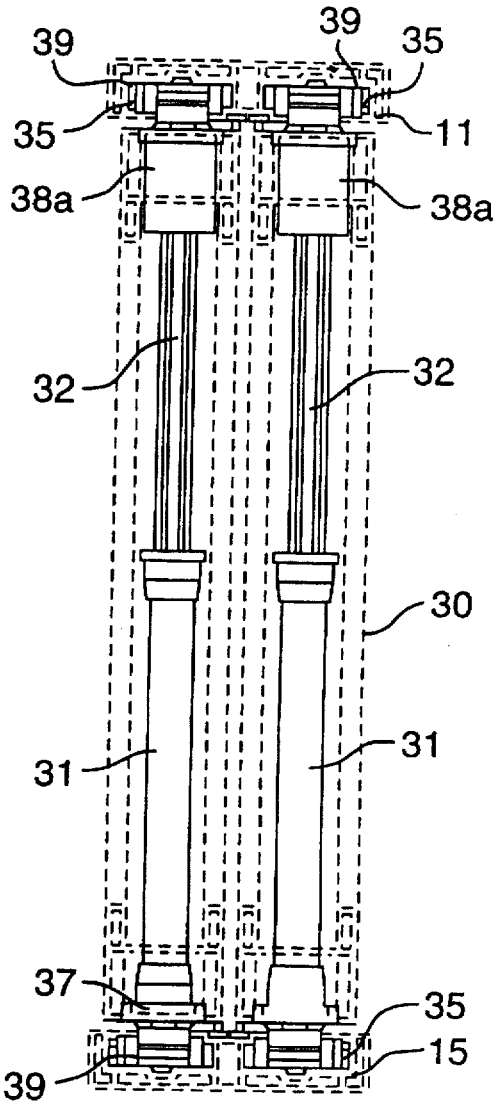
FIG. 2*b* is a end view of the window of FIG. 1.
Figure 2C:
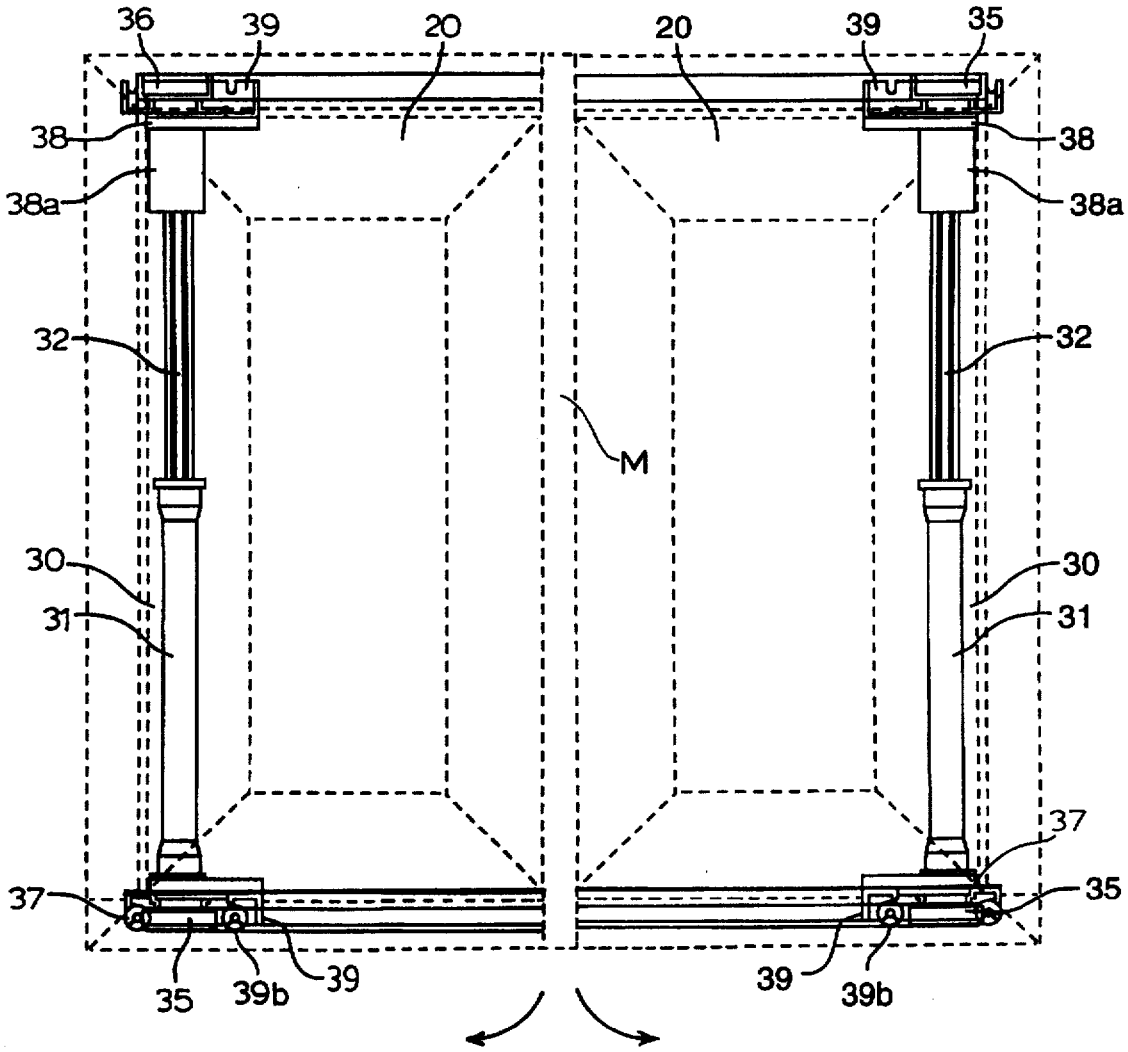
FIG. 2C is a perspective view of an alternative embodiment of the invention.

Referring now to FIGS. 1 and 2 through 2*b* there is illustrated a tilt and slide window assembly. The assembly 5 includes an outer frame portion 10 which is normally hung within an opening established in a building (not shown). Normally nailing flanges are provided for this purpose in order to attach the assembly to the outer frame 10. The frame 10 includes top portions 17 and bottom portions 16 having tracks disposed therein, as best seen in relation to FIG. 2. Within the tracks are contained a pivot assembly which will be hereinafter described. Primarily the pivot assembly includes a pinion 35 and carriers 38 and 37 interconnected by interconnecting portions 32 and 31 making up an interconnecting member 30. The pinions move as the window 20 is slid in the track portion by the movement of the pinion 35 with respect to the rack 18 or 19 respectively. In this way the pinions 35, being interconnected, remain parallel at all times in their motion along the track within which the rack 19 or 18 is disposed. The hardware is shown in normal view while the window assembly is shown in dotted lines, to emphasize the essence of the invention embodied with the assembly.

Referring now to FIG. 2 there is illustrated the window of FIG. 1, wherein windows 20 and 40 are slidable within a track 15 and 17 upon a shoe 39. The lower shoe 39 also is connected to a secondary shoe 39*a* for carrying the window which includes rollers 39*b* and 39*a*1 on the bottoms thereof respectively for ease of movement within track 17. The pinion 35 rests within the shoe 39 as will be described hereinafter. The arrangement of the interconnecting portion 30 will also be described hereinafter. Window 40 therefore has its own interconnected system as can be best seen in relation to FIGS. 2*a* and 2*b*.

Referring now to FIG. 2*a* there is illustrated the sash elements 20 and 40 and the rack portions 19 and 19*a* which accommodate the motion of the pinion 35 along the full length of the track, as best in FIG. 2*b*.

Referring to FIGS. 1 and 2 to 2*b* clearly the track portions 17 and 15 cooperate with the rack portions 19 and 19*a* to provide for engagement with the pinion 35 and its motion when the window remains slidable within the track. By interconnecting the two pinion portions and hence the two pivot shoes, by interconnecting means 30, the shoes remain in a substantially parallel position in relation to one another at all times. This overcomes the problem described in the background of the prior art. By the shoes remaining substantially parallel at all times it is almost impossible for the window to come out of the track when the window is pivoted to be cleaned, and therefore it is no longer necessary to provide braking portions as in previously described inventions of Canadian Thermo Windows, as referred to in the background of the invention.

Figure 1A:
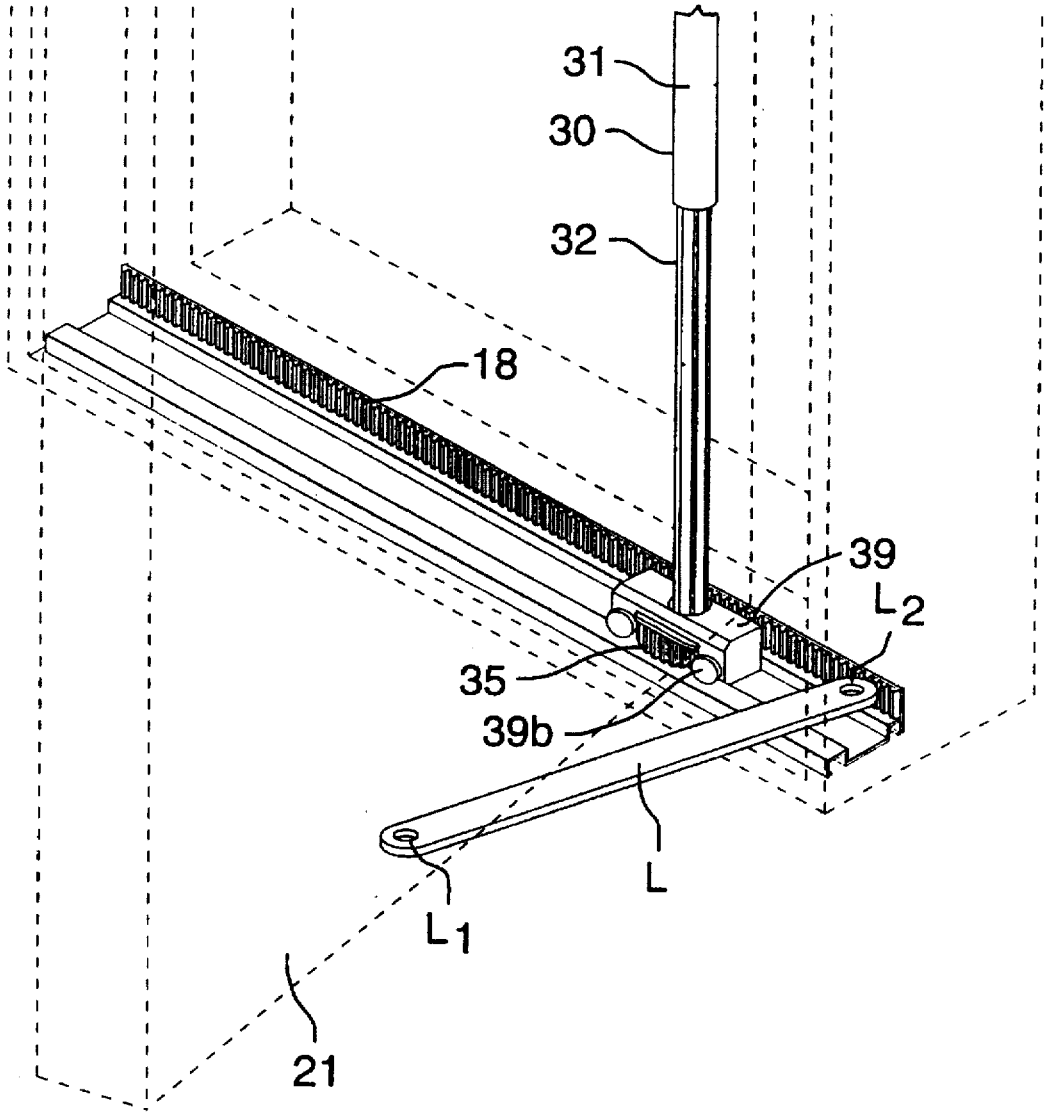
FIGS. 1A and 1B are partial schematic perspective views of casement style windows embodying the invention and depicting the motion thereof and illustrated in a preferred embodiment of the invention.
Figure 1B:
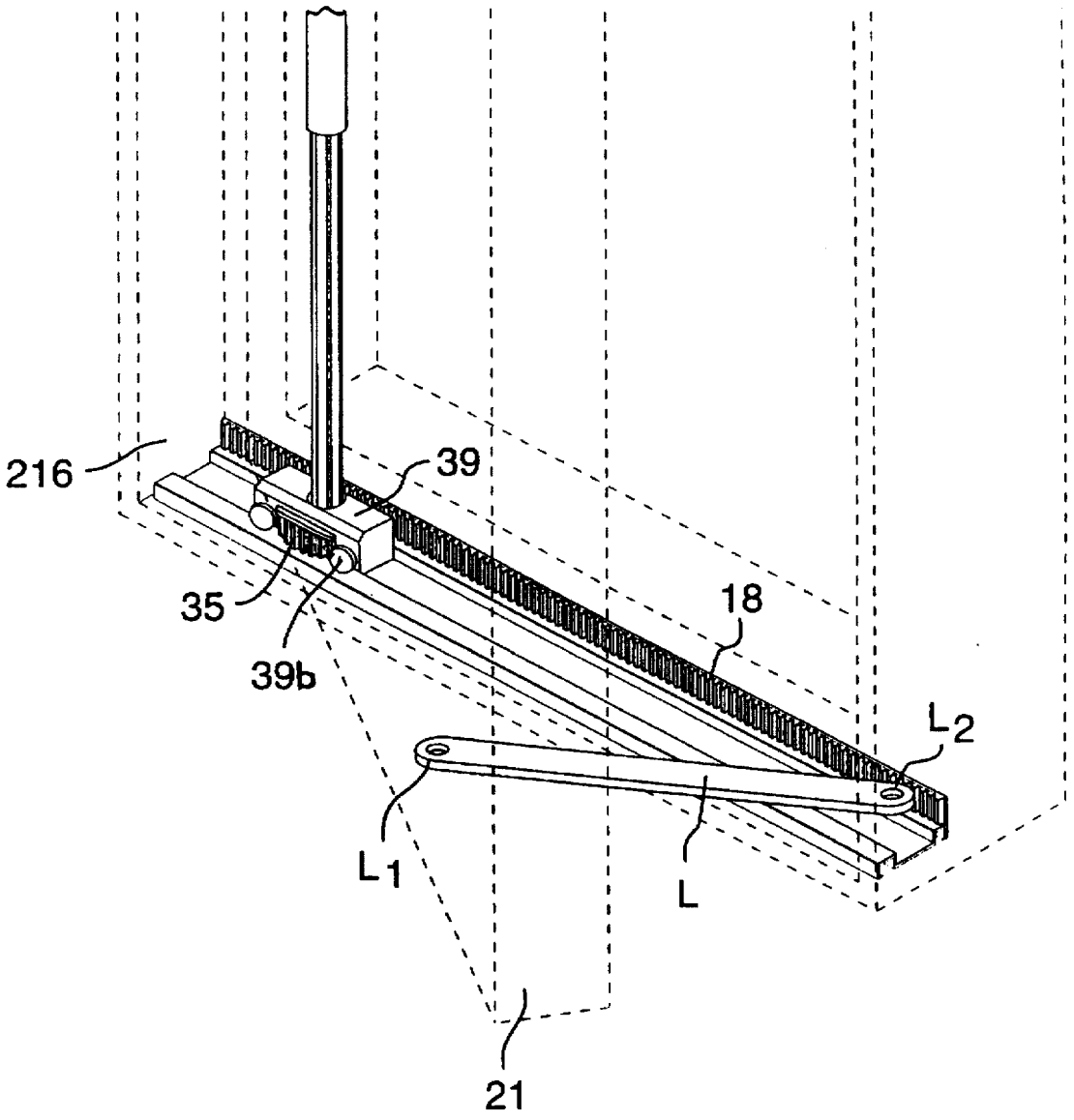

Referring to FIGS. 1A and 1B there is illustrated a casement style window having similar components to that found in relation to FIG. 1 with the exception that only one sash is provided which is fastened on shaft assembly 30 including portions 31 and 32. A link L is provided secured proximate ends L1 adjacent the center of the sash 21 proximate the bottom thereof and adjacent the track 18 adjacent the opening end of the window sash 21. By positioning the sash in this manner a full range of pivoting motion is available. If the link end L1 is removable from the sash, then the window sash may be moved totally to the opposite end remote the pivoting end 21*b* on shoe 39. As with the case of the tilt and slide window a shoe 39 containing a pinion is provided. The pinion is connected to the shaft 30 and engages the rack 18 as it moves along the window sill and header in parallel arrangement between the upper and lower pivots maintained in parallel by the shaft 30. In this manner the casement style window may be pivoted as normal to an open position, and the pivoting end may be moved to the other end of the window frame away from side 21*b* to allow ease of cleaning. By supplying the hardware described without a casement sash, the casement window may be assembled without the need for expensive pivots and linkages and without a great deal of assembly labour. As best seen in FIG. 1D for the casement style window in particular a rollaway screen S may be provided which is housed in the jamb channel as illustrated. The screen S pulls across to engage detent D1 with detent D2 in the opposite channel jamb, whereat it may be locked. This allows a user to clean the glass of sash 21 on the inside without the need to remove the screen as in prior art casement structures.

Figure 1C:
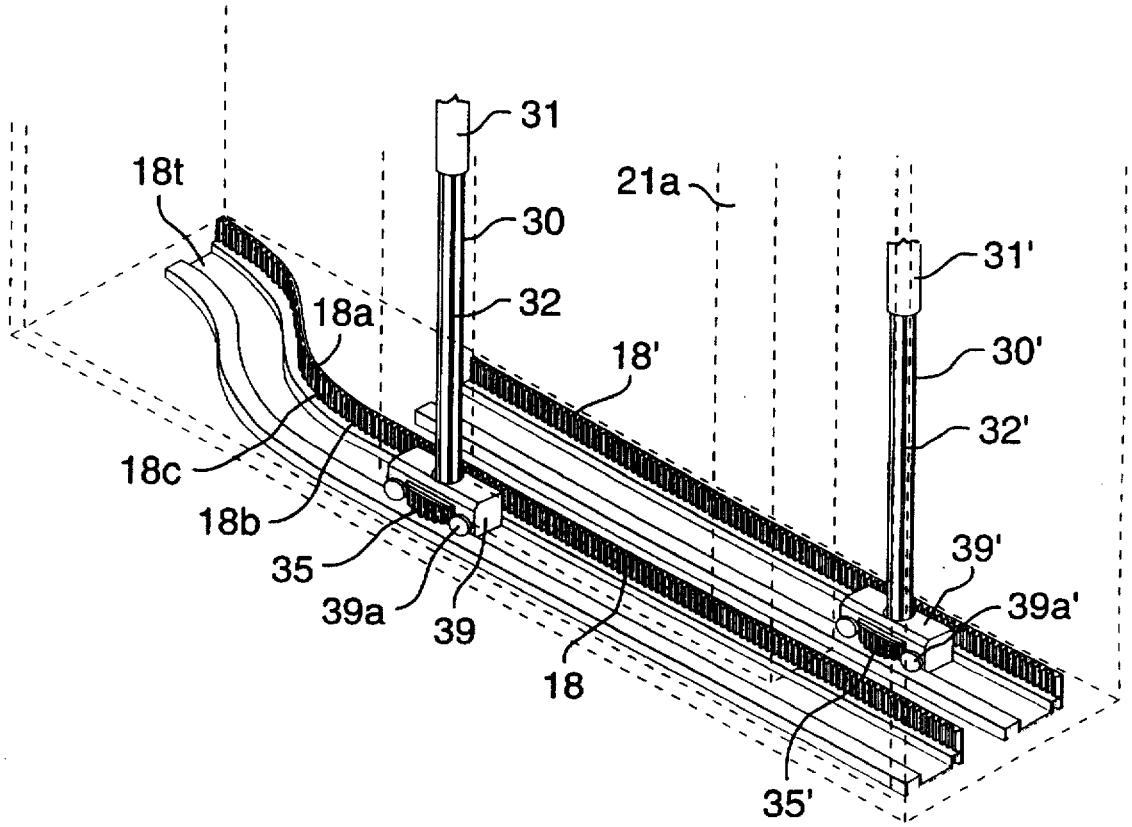
FIGS. 1C is a partial schematic perspective view of straight line windows embodying the invention and depicting the motion thereof and illustrated in a preferred embodiment of the invention.
Figure 1D:
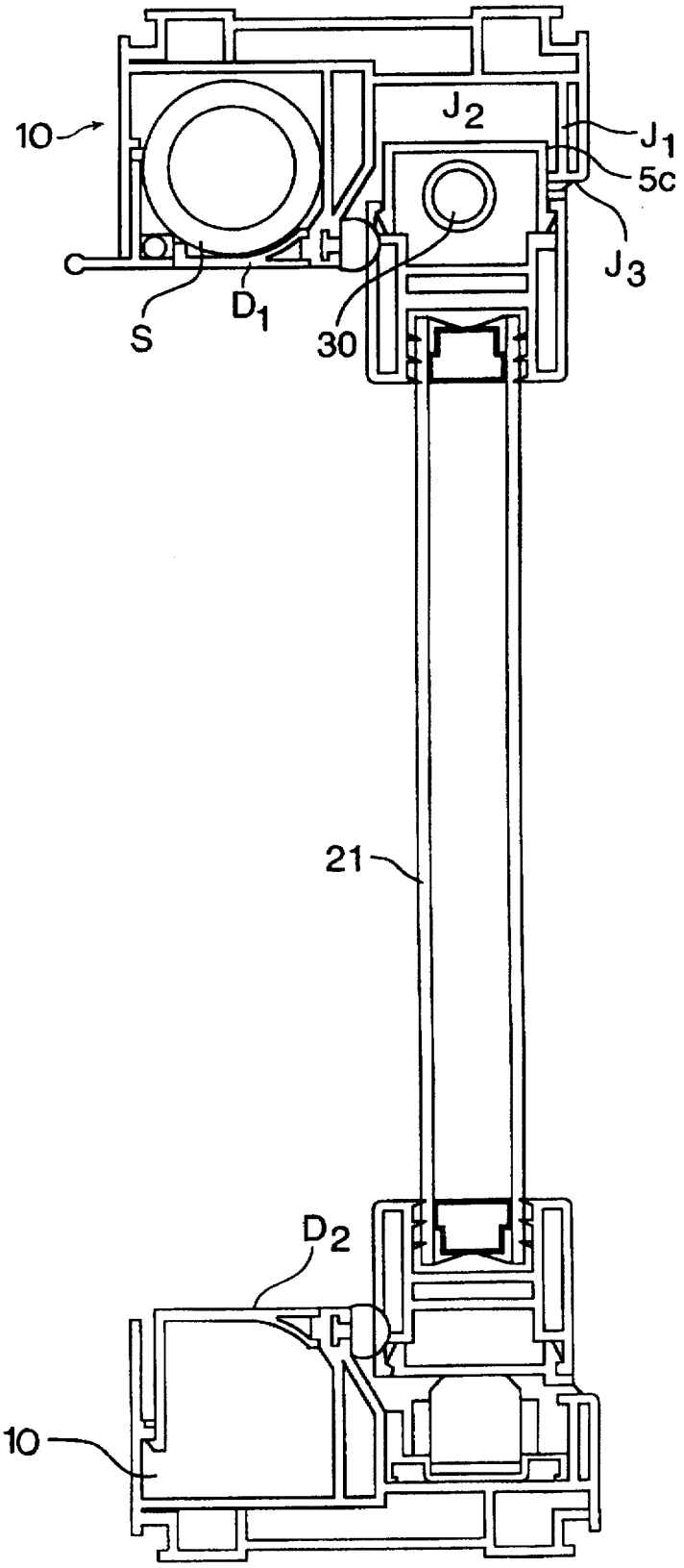
FIGS. 1D is a partial cutaway view of the casement style windows of FIG. 1A depicting a rollaway screen thereof and illustrated in a preferred embodiment of the invention.

Referring to FIG. 1C there is illustrated a tilt and slide type window similar to FIG. 1 with the exception that when closed the window sashes will be oriented in a straight parallel line with one another. In order for this to happen the rack 18 provided includes a portion 18*a* made from fiber filled plastic or the like and joined at seam 18*c* to an aluminum track 18*b*. The sash 21 is therefore moveable as previously described on carrier 39 and rollers 39*a* as urged by pinion 35 until the pinion reaches the curved portion of the track 18*a* a wherein the assembly 30 will move along the curved portions of the track to the terminus of the track 18*t*. The sash portion 21*a* will then but in behind the edge of the sash contained in track 18' and be lockable at that position. The sash 21' (not shown) resides on assembly 30' in track 18'. As pinion 35' moves within the limits of rack 18' the sash 21 cannot adopt a parallel position unless sash 21' is in its fully closed position. Only then can the end 21*a* of the adjacent sash adopt its fully closed position butting up against the sash 21' at the end opposite the carrier assembly 30' and 39'.

Figure 3:
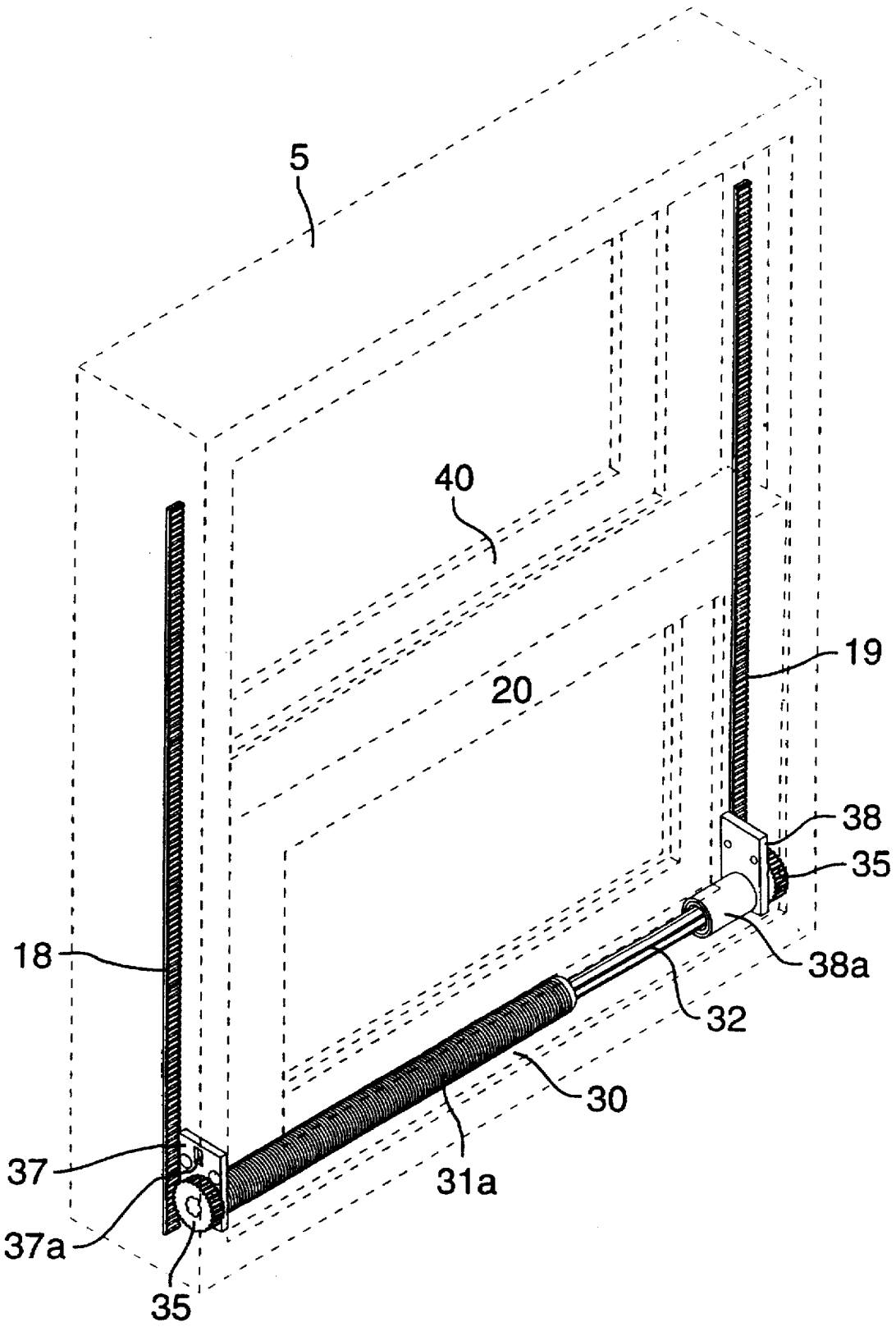
FIG. 3 is a double hung window assembly utilizing hardware similar to that of FIG. 1 and illustrated in a preferred embodiment of the invention.

Referring to FIG. 3 there is illustrated a double hung window assembly embodying a preferred embodiment of the hardware making up the invention substantially equal to that which is disclosed in FIG. 1, with the exception that a coil spring 31*a* is provided around the connector portion 31 of the interconnecting portion 30. By providing the interconnecting portion 31 with a spring 31*a* it will no longer be necessary in a double hung window assembly to provide a sash balance, as the spring 31*a* is pre-loaded to provide the necessary tension, much the same as a spring which is used in a garage door. In this example as a garage door goes up and down the spring is compressed and tensioned depending on the motion of the door and therefore provides for the return motion of the door. Within the window assembly sashes 20 and 40 shown in ghost line are moveable in a manner similar to the garage door example with hardware substantially made up of a pivot or pinion 35 moving on a rack 18 and 19 respectively and being interconnected by the interconnecting portion 30. The spring mechanism 31*a* provides an assist to the user, as in the case of the example, when the window sash is opened.

Figure 4:
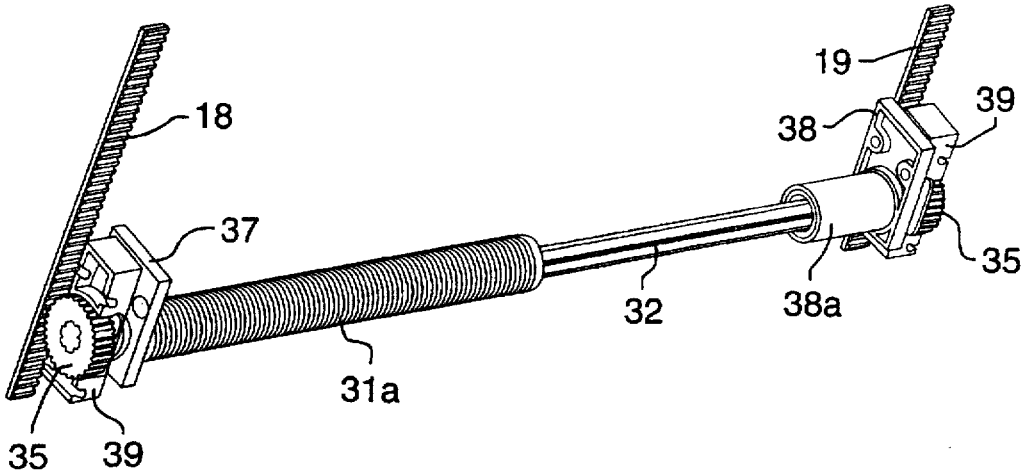
FIG. 4 is the perspective illustration of the hardware only for a double hung window of FIG. 3.
Figure 5:
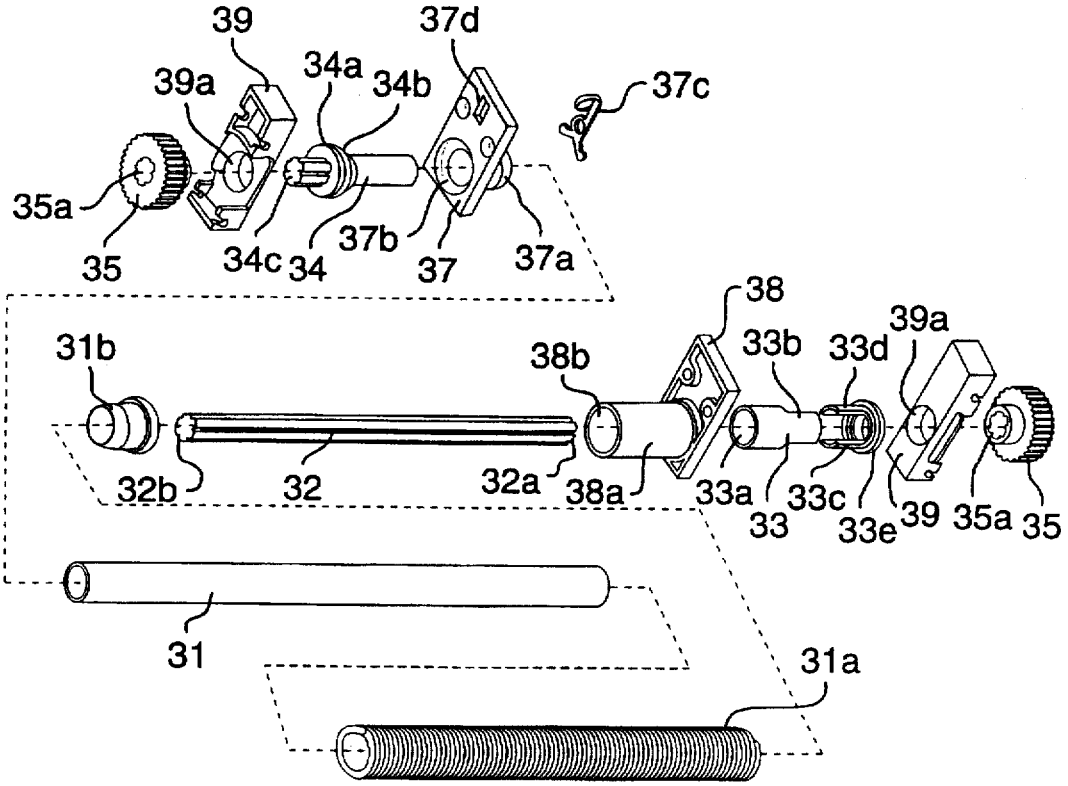
FIG. 5 is an exploded perspective view of the components of the hardware of FIG. 4 to be installed in a double hung window assembly.

Referring to FIGS. 4 and 5 there is illustrated the hardware which is installed within the double hung window assembly of FIG. 3. Pinions 35 therefore are provided, which seat within the carriers or shoes 39. The pinion includes a shaped opening 35*a* which is compatible in shape with the bar stock 34*c* and 32*a* proximate the ends thereof. The pinion therefore will ride on the rack 18 and 19 within shoe 39. Opposed supplementary portion 37 is provided to oppose the shoe 39 in the jamb as it rides in the track. Therefore, referring to FIG. 2*b* the portion 37 and 38 may be readily seen. A combined ratchet and pawl assembly is provided with portion 37 or at least connected therewith. The pawl assembly 37*c* is resilient biased through the opening 37*d* of member 37 so as to release the ratchet 34*b* of shaft 34 when the window is to be removed from the assembly. Proximate the other end of the hardware there is provided a backing member 38 in a unique shaft extension 33 which includes portions 33*b*, 33*d*, 33*c* and 33*a* wherein the shaft end 32*a* extends through. A locking nut 33*e* is provided to lock the entire hardware together and to allow for ease of separation thereof. An adjustable connector 31*b* is provided proximate the other end of member 32*b* which allows for adjustment with regard to the length of section 32 of the shaft so as to allow variation in the sizes of the assembly supported. Portions 31, 31*b*, 32, and 33 makeup the shaft assembly which allows for ease of installation, adjustment, alignment and removal of the sash assembly. Also the hardware described provides for the interconnection of the pivot shoes proximate their sides and provides for parallel motion of the pivot shoes at all times thereby eliminating the need to lock the pivot shoes in the track assembly.

Figure 6:
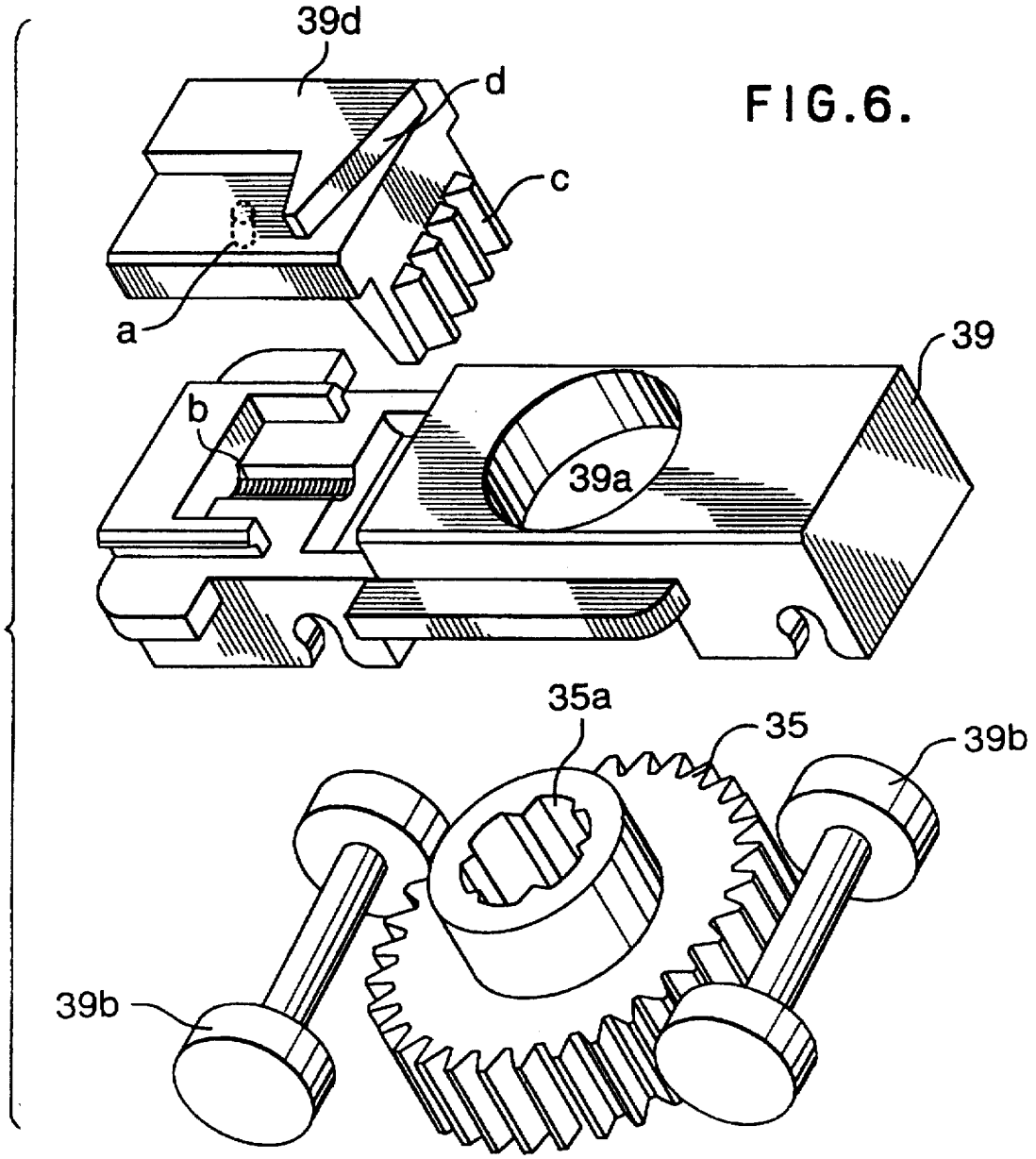
FIG. 6 is a carrier design illustrated in a preferred embodiment of the invention which allows for ease of removal of a window from a window assembly and illustrated in an exploded perspective view.
Figure 7:
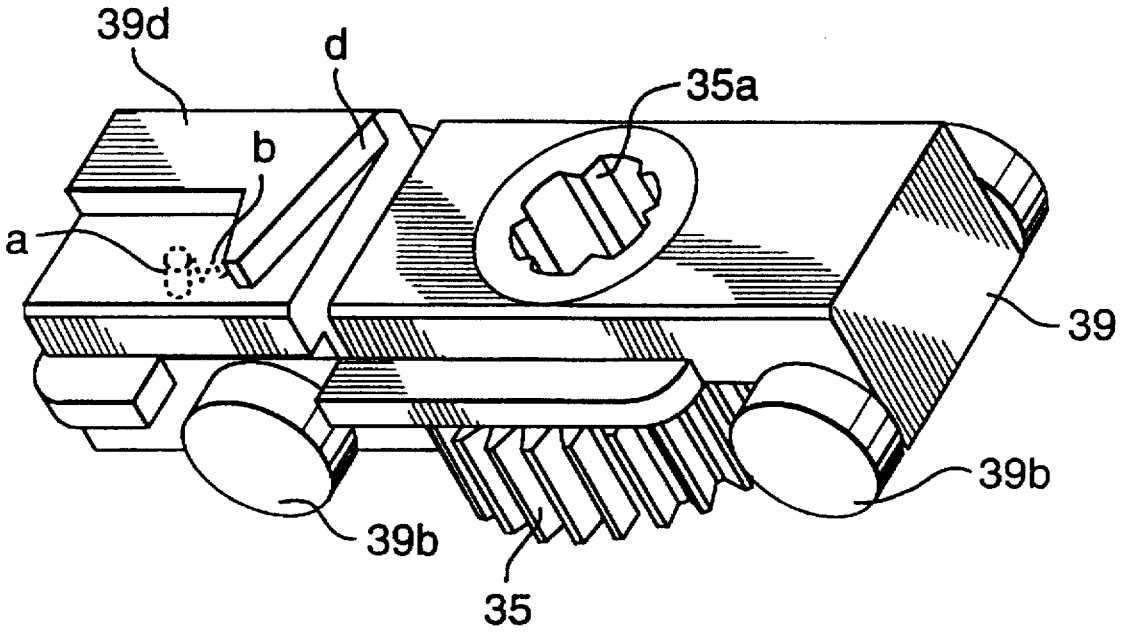
FIG. 7 is an assembled view of the components of FIG. 6.

Referring to FIGS. 6 and 7 there is illustrate an alternative shoe construction which is useful when a window is removed, since the shoe will be locked in position when the window is removed for maintenance or for cleaning. Therefore the shoe 39 includes a spring b and a recess therefor and a supplementary portion 39*d* and a finger of a therefore therefor c are provided on supplementary portion 39*d* which are biased by spring b against the pinion 35 to thereby lock against pinion 35 and prevent the motion of the carrier when the window is removed. A sloped wall d is provided with the carrier supplementary portion 39*d*, which when the shaft is removed or reinstalled thereby releases the supplementary portion away from the pinion or toward the pinion. Therefore when the supplementary portion d is engaged it will drive the supplementary portion 39*d* away from the pinion 35 thereby allowing free motion of the pinion in normal circumstances. However when the shaft is disengaged the portion 39*d* will be free to move as biased by the spring b toward locking the pinion 35 via the teeth c of the supplementary portion 39*d*. The alternate shoe of FIG. 6 and 7 has an opening 35*a* within which the shaft extension 32*a* or 34*c* passes to interconnect with the shoe 39 as previously described. The rollers 39*b* engage with the notches as shown to improve the motion of the carrier in the track.

Figure 8B:
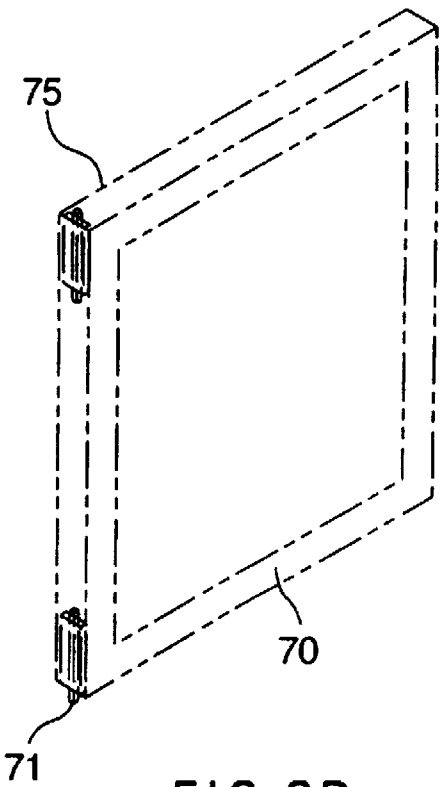
FIG. 8 is a schematic view of a tilt and slide window assembly illustrated to emphasize primarily the hardware therefore and illustrated in an alternative embodiment of the invention.
Figure 8A:
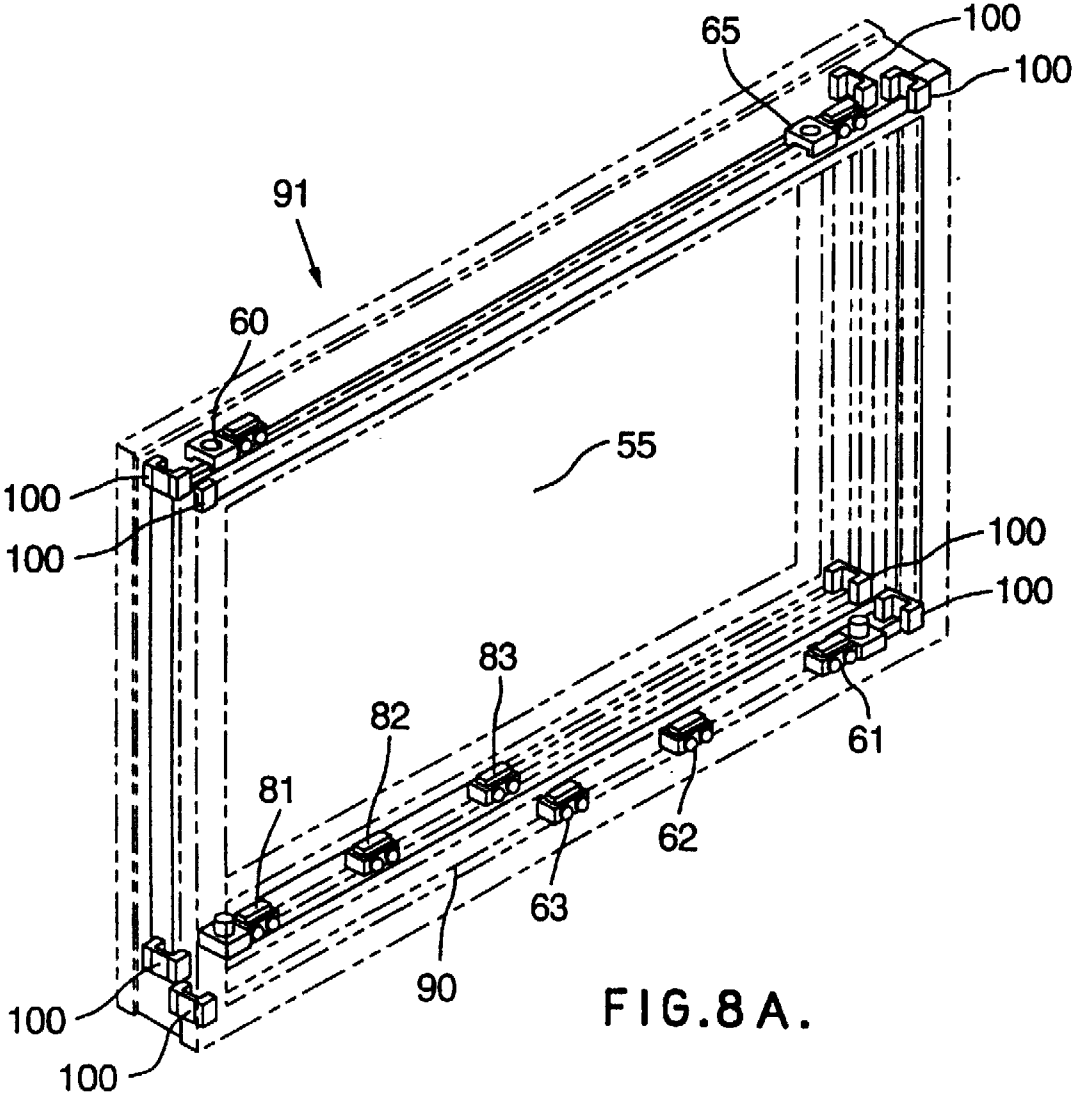
Figure 9:
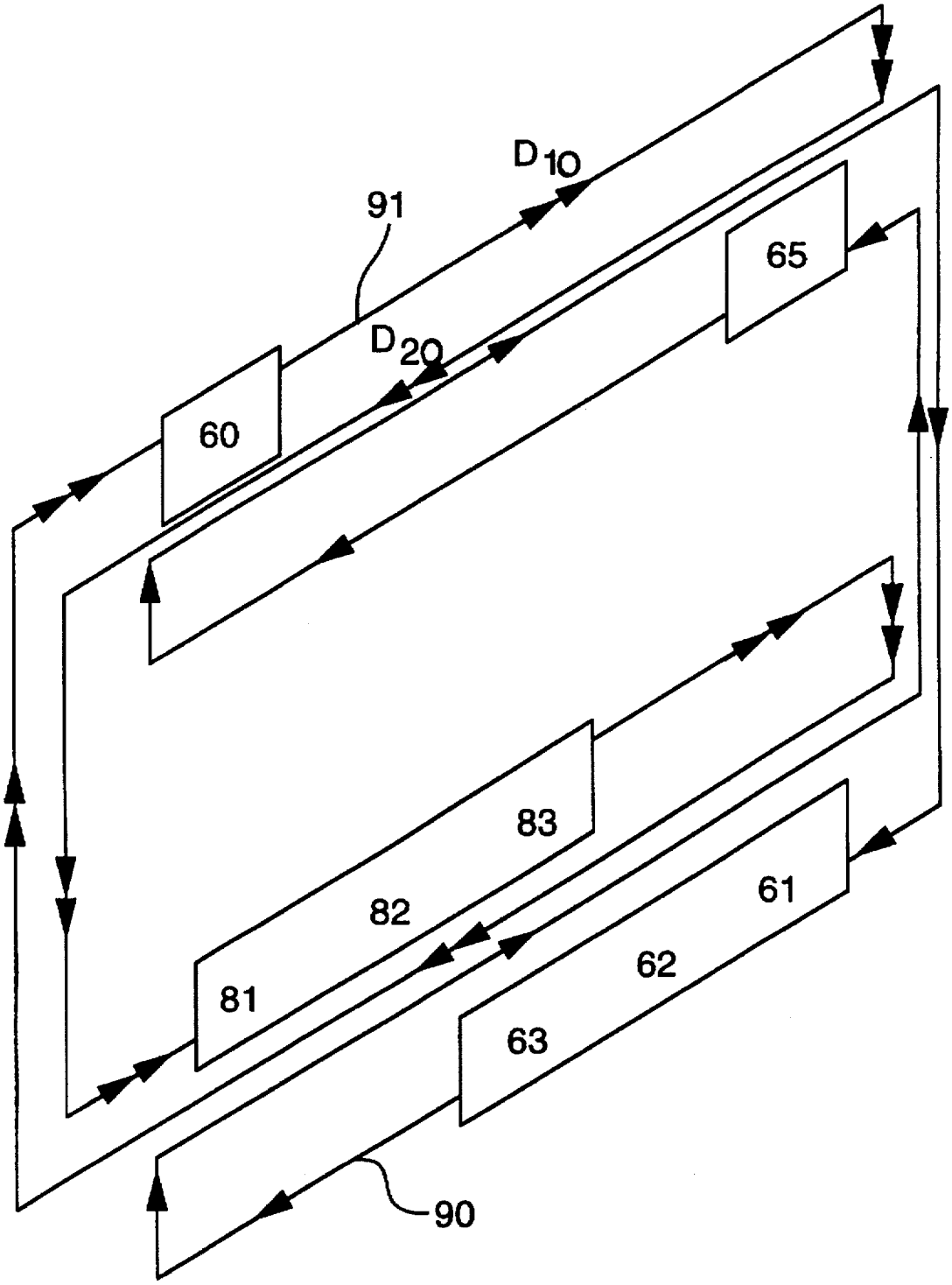
FIG. 9 is a schematic view of the movement of the shoes of FIG. 8 illustrated in alternative embodiment of the invention.
Figure 10:
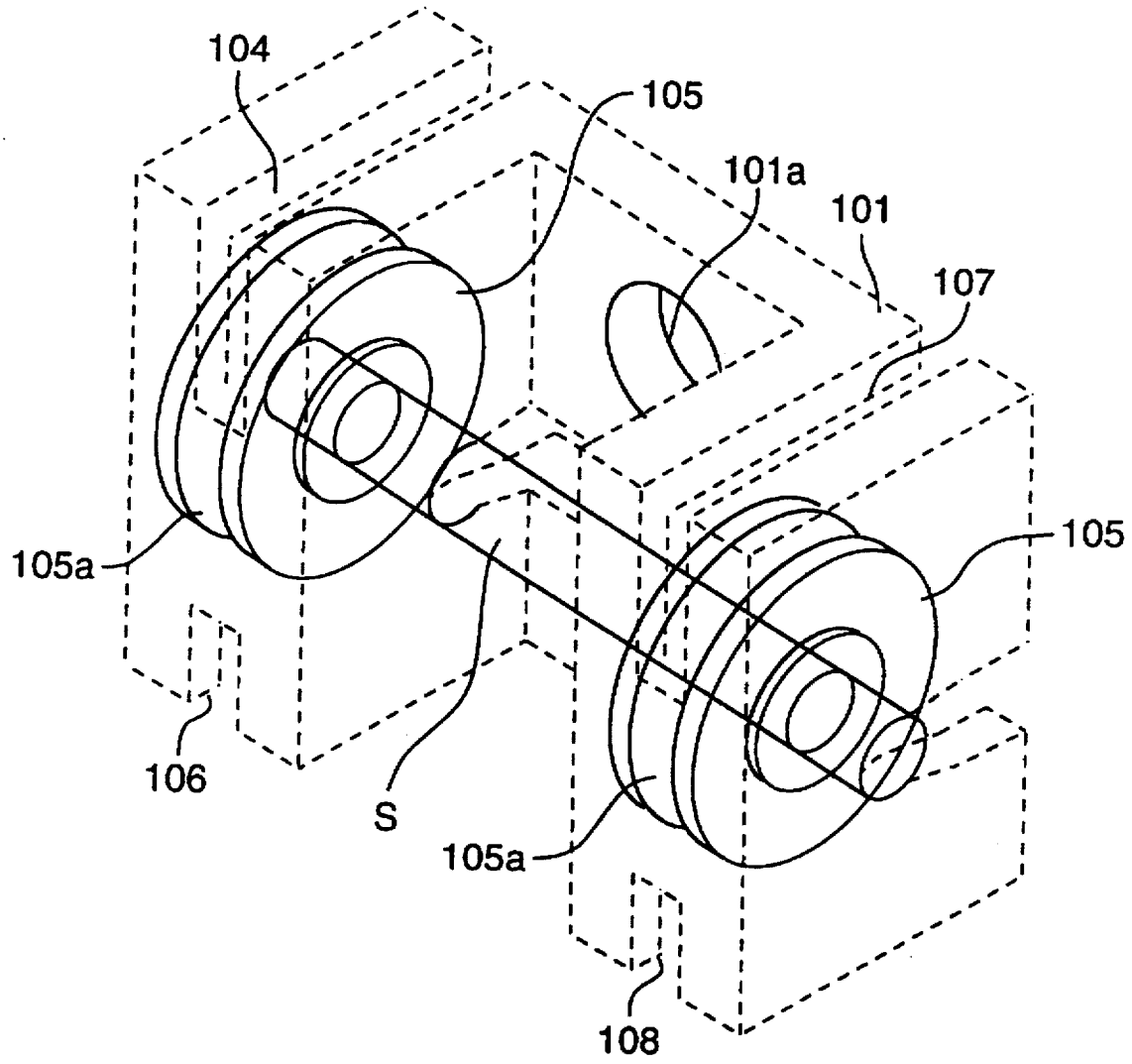
FIG. 10 is a perspective illustration of a pulley arrangement installed at the corners of the window assembly of FIG. 8 and illustrated in alternative embodiment of the invention.

Referring now to FIG. 8, 9 and 10 there is illustrated an alternative embodiment of the invention to maintain the carrier pivots 61, 65, 60 and 81 in substantially parallel alignment and thereby eliminate the need for braking mechanisms. FIG. 8 is illustrated as a tilt and slide frame in ghost line with the window 70 also shown in ghost line having pivot 75 and 71. The pivots 75 and 71 engage with openings within the shoe 61 and 65 in the manner which is known. These pivot pins 75 and 71 may be removed from these shoes merely by retracting them from their locked positions. The sash 70 therefore is moved on the carrier 81, 82 and 83 proximate the bottom thereof in the track portions as shown and within carrier 60 on the top thereof. A similar sash arrangement would be arranged for the other shoes as well but for simplicity sake this is not illustrated. The important aspect is that a cable 91 is connected to the carrier 60 and the carrier assembly 81, 82 and 83 substantially as shown in FIG. 9, so that when the window moves toward the right hand side of the drawing, both carriers will move an equal amount by the movement of the cable, maintaining the pivots 75 and 71 within the shoes 60 and 81 substantially parallel at all times. Similarly, a cable 90 is provided which moves in conjunction with the carrier 63, 62 and 61 and the shoe 65, as best seen in FIG. 9, so that as the shoe 65 is moved in a direction D20 that the carrier 61, 62 and 63 will also be moved in the direction D20. FIG. 9 therefore shows the path of the cable connecting the carrier described above.

In order to allow for the movement of the cable the unique pulley arrangement is illustrated in FIG. 10 wherein the cable will travel through the respective channels 107, 108 and 105*a* within through 105, or through 106, 104, 105*a* within the opposite wheel or pulley 105. Assembly 101 is therefore provided which is affixed within the window frame via opening 101*a* and a fastener, not shown, which assembly allows for the movement of the cable and hence the carriers in a manner as best seen in FIG. 9.

Figure 11:
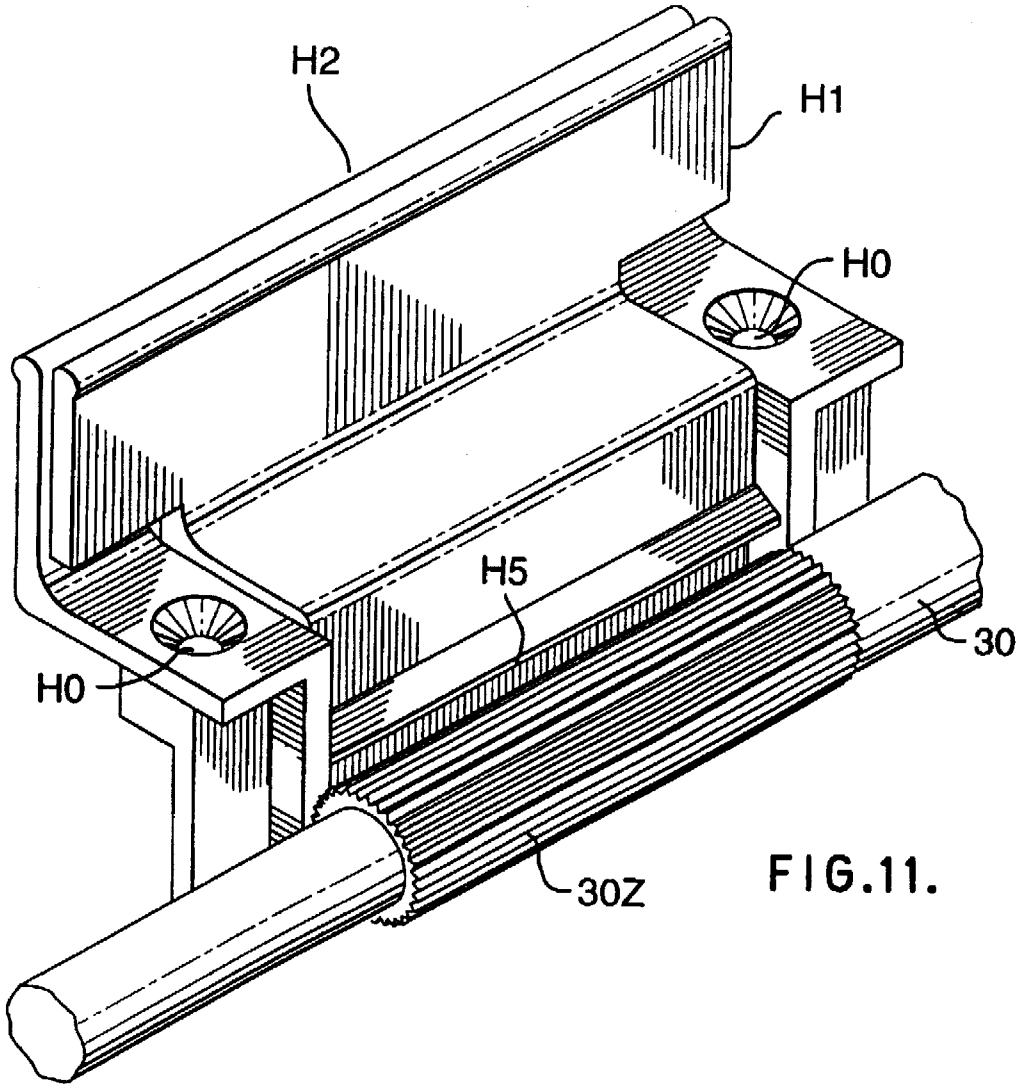
FIG. 11 is a close-up perspective view of a locking mechanism for the shaft assembly 30 shown for example in FIG. 1 and illustrated in a preferred embodiment of the invention.
Figure 12:
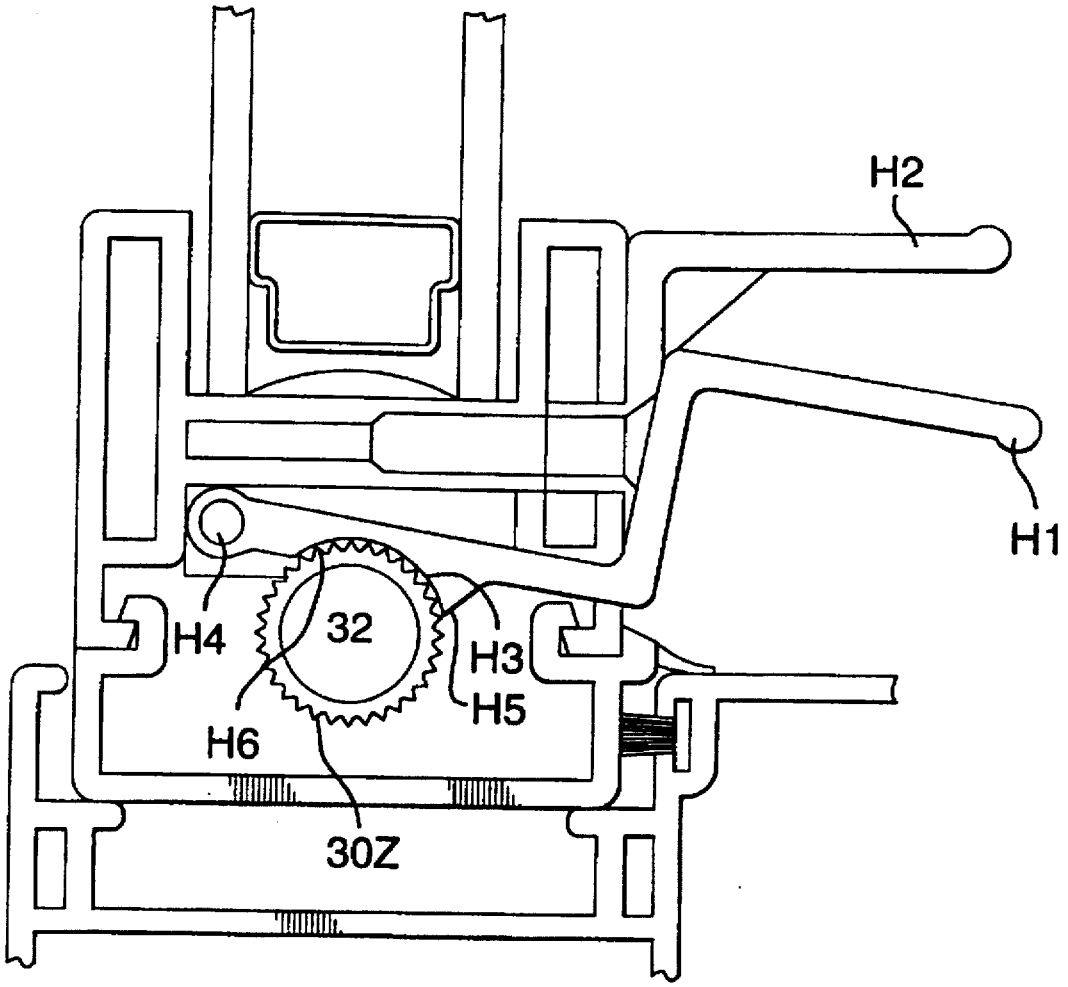
FIG. 12 is an end view of the locking mechanism of FIG. 11 illustrated in a preferred embodiment of the invention.

Referring now to FIGS. 11 and 12 there is provided a locking mechanism for the shaft 30 which may be used with any closure assembly. A handle assembly H is provided including a stationary portion H2 fixed to the sash 21 and a moveable spring biased portion H1 biased to a continual locked position via spring leaf S2. The handle portion H1 includes a pivot H4 and detent portions H5 and H6. Normally the spring S2 will cause the handle portion H1 to remain in engagement at detents H5 and H6 with gear portion or serrations 30Z of the shaft 30. Therefore the window or door is locked in that position and cannot be pivoted or slid. When a user engages the handle H1 and presses it towards H2 the detents H5 and H6 release from the gears 30Z and hence the window or door may be repositioned as desired. At that repositioned location when the user releases the handles the window or door will again become locked.

Figure 13A:
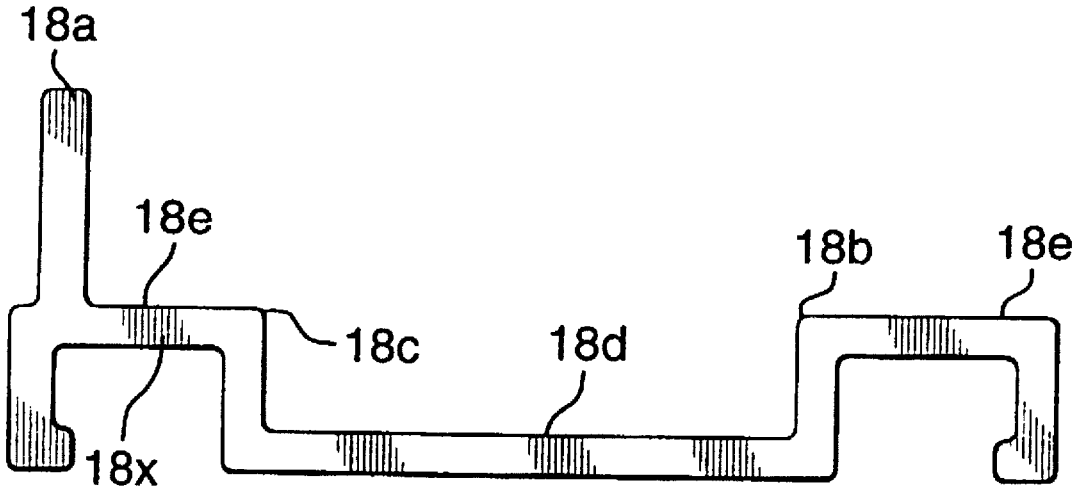
FIG. 13A is an end view of the track profile used in conjunction with the lock block assembly of FIG. 13 and illustrated in a preferred embodiment of the invention.
Figure 13B:
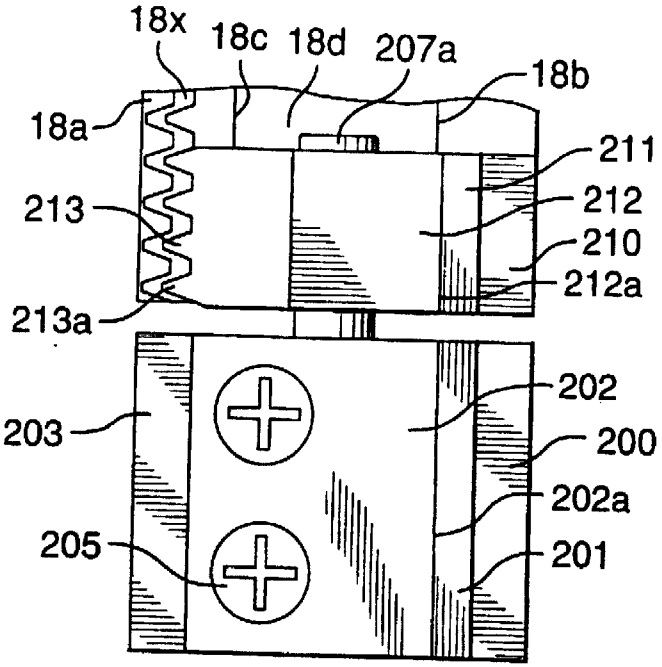
FIG. 13B is a top schematic view of the lock block assembly of FIG. 13 shown engaging the rack portion of the track and illustrated in a preferred embodiment of the invention.
Figure 13C:
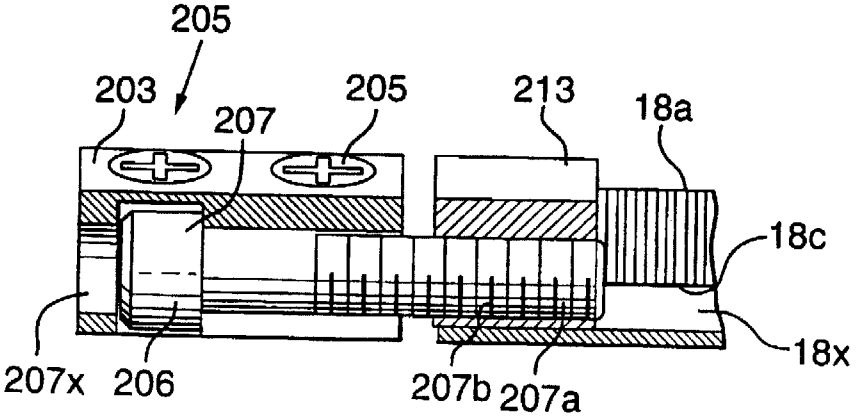
FIG. 13C is a side cross-sectional view of the adjusting cap screw used to adjust the track within the sill or header or jamb portions and illustrated in a preferred embodiment of the invention.
Figure 13:
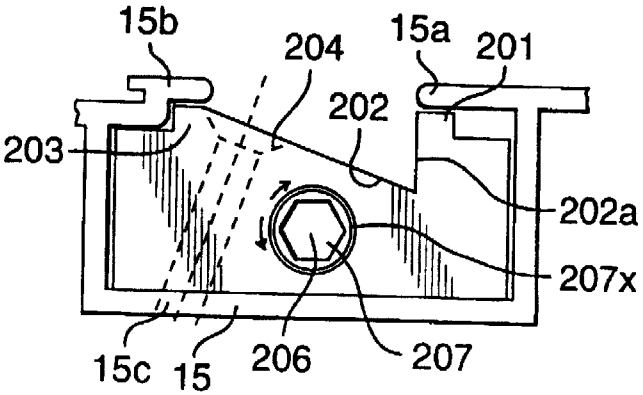
FIG. 13 is an end view of a locking block assembly illustrated in a preferred embodiment of the invention.
Figure 17:
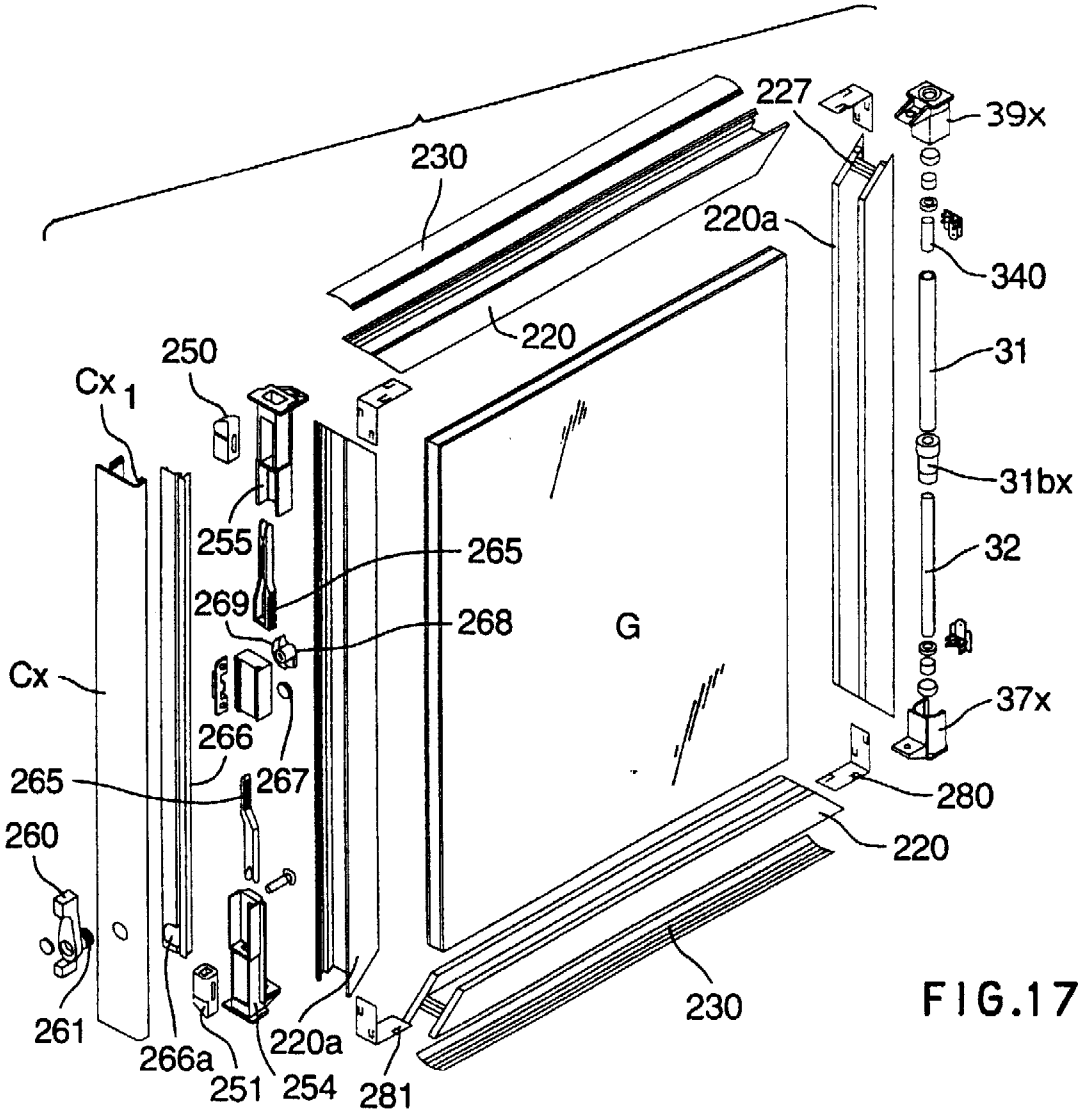
FIG. 17 is an exploded perspective view of a window sash for a tilt and slide or casement window illustrated in a preferred embodiment of the invention.
Figure 18:
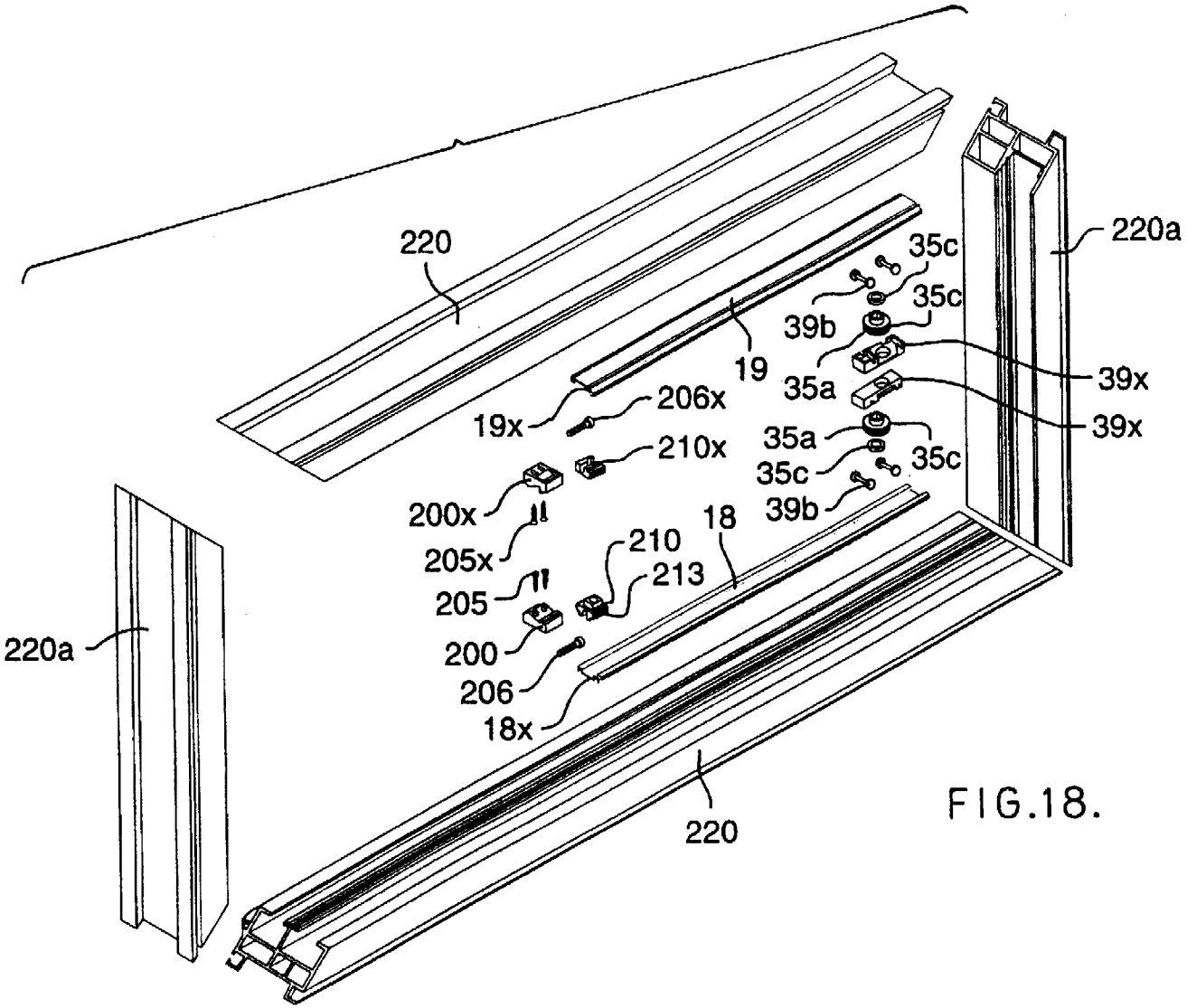
FIG. 18 is an exploded perspective view of the header, sill and jamb portions of the window assembly illustrating the track and its positioning in relation to the sill and header and illustrated in a preferred embodiment of the invention.

Referring now to FIGS. 13, 13*a*, 13*b*, 13*c* and FIG. 18, there is illustrated a track portion 18 and 19 which is to be installed within, as shown in FIG. 18, the sill and header 220 of a frame assembly also including upwardly extending jamb portions 220*a*. The track portions 18 and 19 therefore are installed within the profiles as seen in FIGS. 2*b* and 18 by the provision of a locking block assembly 200 which includes an adjuster nut 210 which engages the rack portion 18*x* of the rack 18*a* of the track profile 18. The profile therefore includes the rack 18*a*, a riding portion for the rollers 18*e* which will be explained hereinafter, and a recess 18*d* wherein a carrier as best seen in relation to FIG. 14 rides with the exception of the rollers. The track 18 therefore must be locked in position in the sash 220, and this is affected by the locking block 200 and the moveable nut 210. As best seen in FIG. 13*c*, the track is inserted into the sill profile as shown so that the carrier may ride on the track. The assembly of FIG. 17 for the sash is therefore engaged with the carrier. The block 200 therefore is screwed down through the profile 15 into the wooden frame member not shown via opening 15*c* in the profile and 204 in the block 200. Two fasteners 205 therefore are provided, and as shown in FIG. 13, they are inclined at an angle to the vertical in order to allow for the provision of an adjuster 206 which is accessible through the opening 207 in the block 200 wherein a cap screw having a head 206*a* having an allen key type access slot is provided. The threading 207*a* extends down to the end 207*a* proximate the nut 210.

As best seen in FIG. 13, the lock block 200 and the locking nut 210 have a profile substantially as shown with a triangular shaped cut out provided adjacent the top thereof and wherein abutting portions 201 and 203 are provided to engage with the flanges 15*b* and 15*a* of the profile of the sill portion 220. The triangular cut-out portion includes an upwardly vertical face 202*a*, and bottom 202. Similarly the nut has a shoulder 211 provided and a substantially triangular shaped cut out 212 and an upwardly extending face 212*a* for engaging with the sill profile 15 similar to that which is illustrated and described in relation to FIG. 13. The rotation therefore of the cap screw 206 results in the movement of the nut 210 in relation to the block 200 which is fastened in position. The adjustment therefore of the screw allows for the thread to engage a threaded opening not shown in the nut 210 so that the rack portions 213*a* provide engagement with the rack 18*a* of the track portion 18 and will allow for fine adjustment in the positioning of the track 18 and the locking in position of the track. It has been found sufficient that by providing the block and the adjustment of the nut, it will sufficiently position and lock the track in position and allow for the adjustment of the track which will then further allow for the adjustment of the pivots as best seen in FIGS. 1, 1*a*, 1*b*, 1*c*, FIG. 2, FIG. 3 and FIG. 17 so that the parallelism is not lost, and if fine adjustments once installed are required to the window sash to maintain the parallelism of the system, this is very easy to do. Should the system go out of parallel and require fine adjustment to restore the parallelism, a mere rotation of the head 207 is required for both the sill and headers 220 so that the system is squared.

The notch portion defined by the faces 202*a* and 202 have a unique purpose in that the latch portion 251 as well as 250, as best seen in FIG. 17, will engage with the face 202*a* and provide a lock detent for the lock 251. This adds reinforcement to the lock provided in that should the triangular shaped detent of the block not be provided, then the lock 251 would engage flange 15*a* and in time would wear out that flange in that particular locking position. The nut 210 has a similar function so that either the nut or the block can function as the detent for the latch. Specifically in FIG. 18, the screw 206 is shown being engageable from the nut toward the block, and in fact it is accessible in either direction as shown in FIG. 13 and FIG. 18 without changing the advantages of the system. For access purposes, depending on the installation and the type of window, it may be easier to adjust as shown in FIG. 18 as opposed to FIG. 13. Preferably the block is made from fiber-filled nylon. Alternatively, the block may be made from aluminum. The nut may be made from fiber-filled nylon as well.

Figure 14:
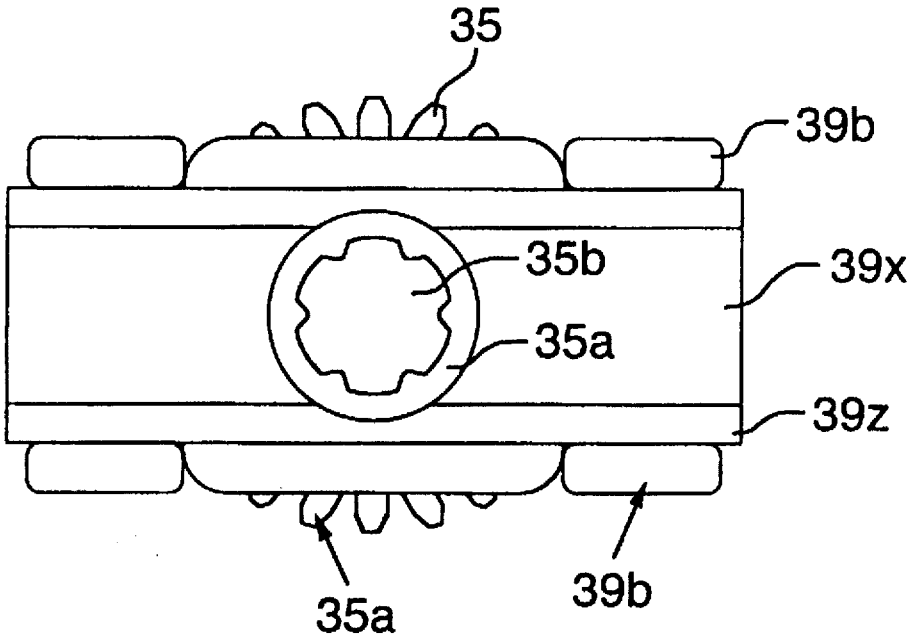
FIG. 14 is a top view of the carrier for the shaft assembly of FIG. 17 and illustrated in a preferred embodiment of the invention.
Figure 14A:
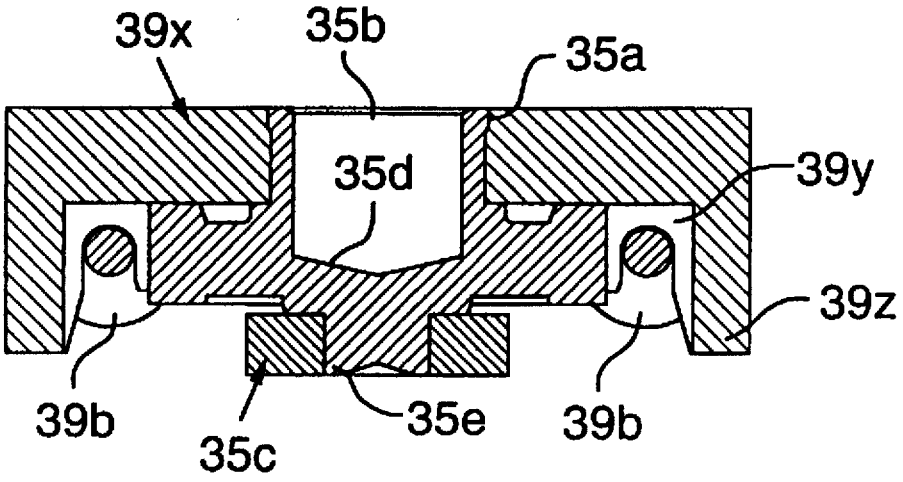
FIG. 14A is a cross-sectional view through the diameter of the opening 35*b* of FIG. 14 illustrated in a preferred embodiment of the invention.

Referring to FIGS. 14, 14*a* and 18, there is illustrated a carrier 39*x* which includes a pivot portion 35 for engaging with the shaft portion 32 and 34*c* of the pivot assembly and for carrying that shaft assembly and the pivoting end of the sash in the track 18 and 19 respectively of FIG. 18. The carrier includes a portion 39*y* provided therewith to carry the rollers 39*b* therein. This is very similar to the carrier illustrated and described in the previous descriptions and more specifically in relation to FIG. 1*a* and 1*b*, with the exception that the details of the carrier were not shown at that time in relation to the thrust wheel 35*c* provided on the bottom.

The carrier, as best seen in FIG. 1 a therefore rides on the rollers on the track profile seen in FIG. 13A on the surfaces 18*e* for the roller wheels 39*b* and in the notch or cut-out recess 18*d* for the side portions adjacent the roller 39*b* at 39*z*. The pinion portion 35 therefore has an opening 35*b* for receiving the shaft 32 which extends toward the bottom of the opening 35*d* and which opening 35*b* as best seen in FIG. 14 is compatible with the shape of the shaft 32. The outer surface 35*a* of the opening 35*b* is compatibly shaped with the opening in the carrier so that the opening 35*b* may be accessible to the shaft 32. At the bottom of the pinion portion 35 is a thrust wheel carrying portion 35*e* which carries the thrust wheel 35*c*. The thrust wheel 35*c* therefore rides in between the shoulders 18*c* and 18*b* on the surface 18*d* of the track profile 18. The thrust wheel is provided to accommodate any wind load which may be placed on the system when the window is opened. Further, in the normal meshing of gears with a rack, there is a thrusting force created as the pinion 35 moves on the rack 18*x*. Therefore, the thrusting wheel will engage from time to time the shoulders or the surfaces defined by the shoulders 18*c* and 18*b* so as to maintain the parallelism and the accuracy of the installation of the window system. A pinion gear 35*a* is therefore provided between the thrust wheel 35*c* and the pivot receiving opening 35*b* which operates substantially as described in relation to FIG. 1A and FIG. 1 in that as the window rotates the pivot rotates causing the gear 35*a* to rotate and move on the track. This is particularly advantageous when the pivot assembly is provided on a casement window as best seen in relation to FIG. 1A in that it is desirable to have the window move away from a pocket provided in the window jamb as best seen in relation to FIG. 1D so that the sash profile will not engage the jamb profile but will readily clear the jamb profile as the window is opened. For example, as best seen in FIG. 1D, proximate the top thereof, it may be readily seen that a pocket is provided in the jamb profile so that the pivot assembly 30 is accommodated at that end of the window. However, a flange portion unlabelled engages the sash cover portion so that within the jamb J1 there is a pocket J2 provided which improves the seal of the window in that the cover portion SC extends into the pocket J2 when the sash is closed. However, when the sash is pivoted as in the case with the casement window of FIG. 1C, the pinion gear when pivoted will move the sash and the sash cover SC out of the pocket J2 away from the jamb J1 and provide suitable clearance so that the sash cover SC will not engage with the jamb portion J3 which is a flange and therefore will clear easily the pocket and all its enabling portions. When the casement window is closed, the opposite happens and the sash cover SC will engage the pocket J2 and be moved in position with the pivoting of the window to the closed position.

The rollers 39*b* therefore provide a smooth motion of the closure system in relation to the track which would not be present if the rollers were not provided since the track is made from aluminum. The rollers are not absolutely essential in every embodiment, however, it is preferred.

Figure 15:
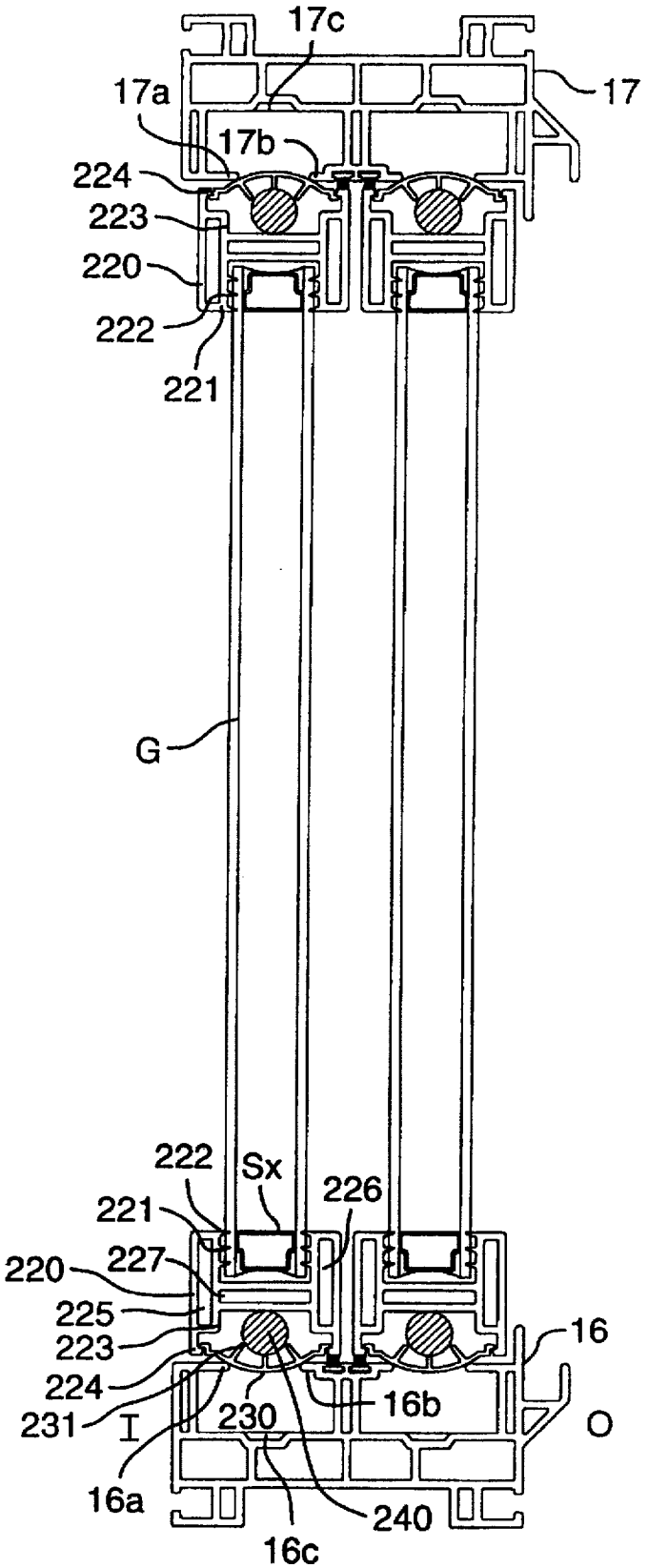
FIG. 15 is an end view of the sash portions for a tilt and slide window assembly from the opening end of the window and illustrated in a preferred embodiment of the invention.
Figure 15A:
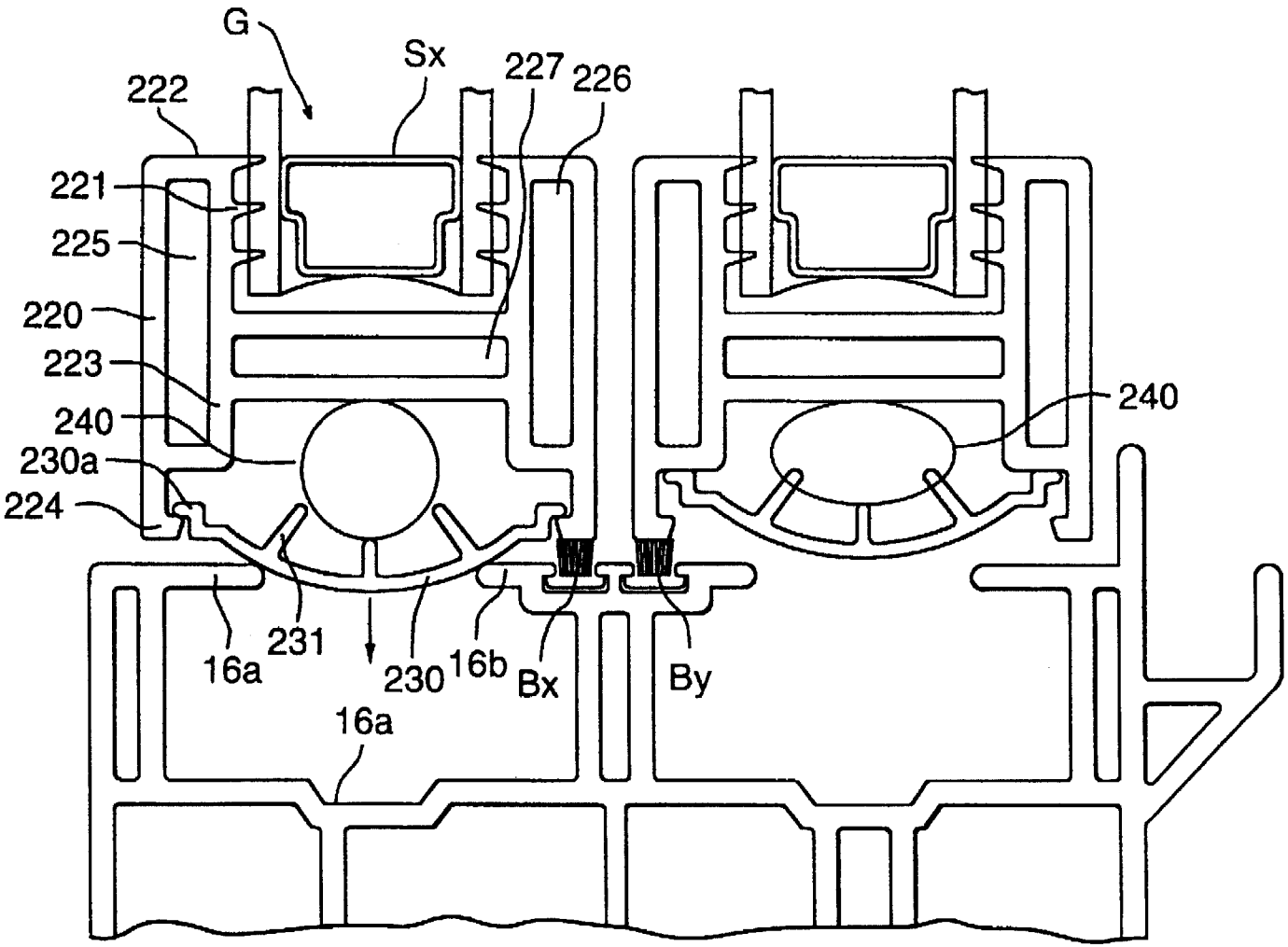
FIG. 15A is a close up view of the section of the assembly of FIG. 15 where the sash abuts with the sill and illustrated in a preferred embodiment of the invention.

Referring now to FIG. 15, there is illustrated two sashes side by side shown in end view. The sashes are made substantially as constructed in relation to FIG. 17 wherein the sash 220 is defined by a central I-shaped portion 227 having an opening therein and two side abutting portions 225 and 226. A pocket therefore for receiving the glass G is defined at 222. Fin seal portions 221 are therefore provided for abutting the glass G which contains the normal known seal portion SX. The window sash profiles also include flange portions 224 proximate the opening opposite the glass G. Within that opening there is provided in use a closed cell caulking foam which is compressible at portion 240. This portion extends totally along the sash profile within the opening as shown with the exception of the portion adjacent the pivoting assembly. A cover portion therefore is provided at 230 which engages the tab portions 224 proximate each side of the sash profile. This cover portion when inserted is flexed downwardly as the closed cell foam 240 is compressed as best seen in FIG. 15*a* so that the flange portions of the cover at 230*a* engage with the flange portion of the sash at 224 to provide a compressed seal for the track cover 230. The track cover is defined as a track cover although it does occupy the sash as a component thereof in that as the sash is closed over the opening defined between the flange portion 16*a* and 16*b* as best seen in FIG. 15*a*, the snap cover portion will extend down into and engage with the flanges 16*a* and 16*b*, thus covering the track and snapping into position each time the sash is opened and closed. The typical seals BX and BY are provided as is known in the art.

Alternatively, as best seen in FIG. 1D, the sash covers may include alternative embodiments shown proximate the jamb portions 16*a* and 17*a* of the window assembly. Alternatively, a cover portion may be provided over the track portion 15 of sill portion 220 and header portion 220 of FIG. 18 that engages with the sash profile in a similar way to that of the track cover of FIG. 15*a* with the exception that the track cover only extends over the second half of the track, that is to say the second half not carrying the window. For example as shown in FIG. 2, the wheel portion 39*a* may be eliminated and the track cover may extend along the track portion opposite the pivot assembly so that the sash may slide on the track cover and be assisted to be supported by that track cover only in the second half of the track profile thereby eliminating the second carrier of FIG. 2. The track cover therefore in FIG. 2 as an example would extend from the carrier 39*a* toward the left side of the page to allow the pivot assembly 35 to move to approximately the position of the present carrier 39*a* wherein it would engage the track cover. In the movement of the carrier 35 to that position, the other end of the window would already be supported by the track cover. This installation therefore would eliminate the carrier 39*a*.

Figure 16B:
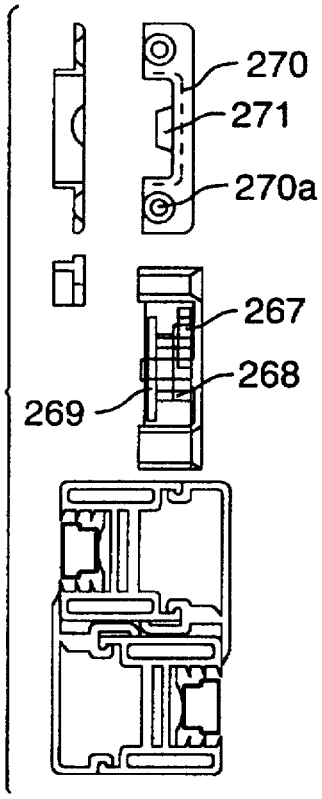
FIG. 16B specifically illustrates the latching plate and latch of the central locking system and illustrated in a preferred embodiment of the invention.
Figure 16A:
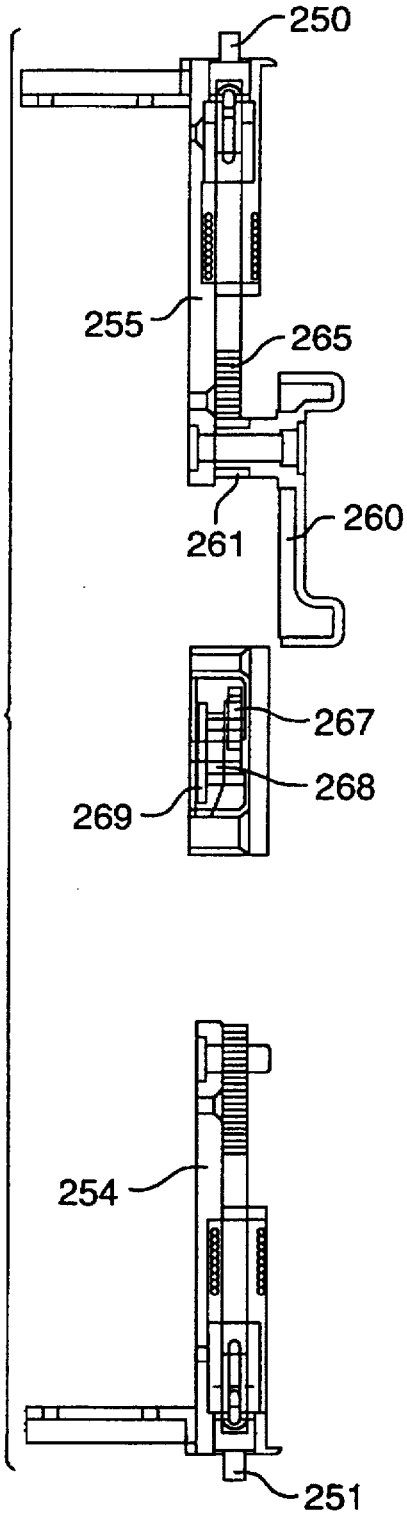
FIG. 16A is an end view of the central locking system of FIG. 16.
Figure 16:
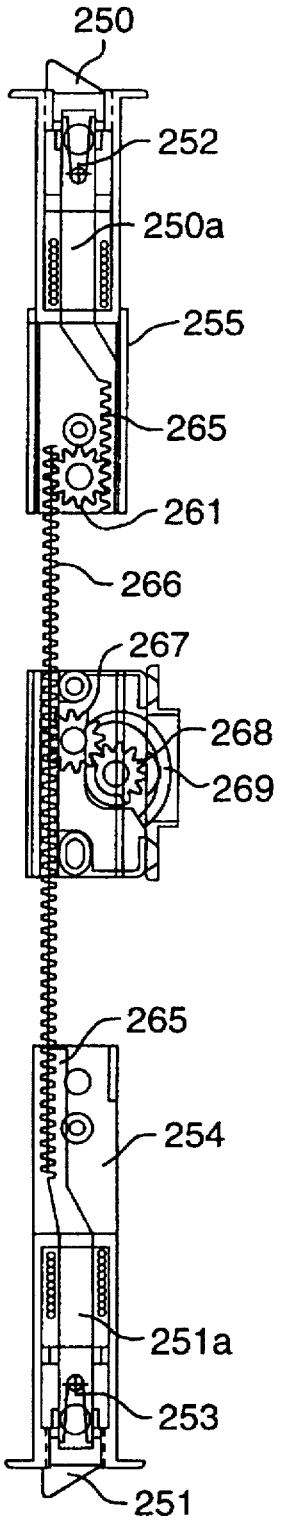
FIG. 16 is a schematic end view of a central locking system best seen in FIG. 17 and illustrated in a preferred embodiment of the invention.

Referring now to FIG. 16B, there is provided locking detents 250 and 251 which engage with the locking detent portions 202 and 212 of the lock and nut portions 200 and 210. These locking portions 250 therefore and 251 are operated by a handle 260 as best seen in FIG. 16A which is rotatable to cause the motion of the rack portion 265 and the detent 250 into and out of the locking abutment provided with the lock block and the lock nut 200 and 210 respectively. In FIGS. 16, 16A and 16B, the installation is provided for a casement window assembly. In the United States Patent Application described in the Summary of the Invention which was incorporated by reference, there is no provision of a casement-style window lock. Nor was there the provision of a lock block or nut detents 210 and 200 respectively. The handle therefore 260 is rotated by the user which causes the movement of the corresponding pinion gear 261, the rotation of the pinion gear 261 affects the movement of the rack 265, and the latch engaging portion 250*a* and 251 a carried within the housings 255 and 254 respectively as best seen in relation to FIG. 17. The rotation of the pinion will therefore also cause the motion of the rack portion 266 sufficiently as provided by the opening 266*a* of said rack portion to allow for engagement of said rack portion with said rack portion 265 with the bottom portion affecting the latching and unlatching of detent 251. Intermediate the two latching portions for the casement window is provided a second pinion 267 which is rotated effectively by the movement of the rack portion 266. Rotation of the pinion 267 causes rotation of the pinion sector 268 which is engaged with the locking detent 269 for the latch plate 270 and the detent 271 thereof. This latch plate is typical for casement windows as is the movement of the lock 269, i.e. the rotation thereof. However, with the central locking system provided with this invention, it is the one handle operation of both the detents 250 and 251 and the casement window lock 269 which is in combination the essence of the central locking system. Alternatively, the casement window portion may be left out and the essence of the locking system therefore includes the locking block in the track which provides a detent for the locks 250 and 251 respectively.

As best seen in relation to FIG. 17, there is provided a cover C(x) which hooks into the sash profile similarly to the cover 230 previously described in relation to FIGS. 15 and 15A through which the handle portion 260 extends. Therefore, the latch assembly is contained within the sash profile, and the only portion extending outside of the sash profile is the handle portion. This handle portion is considerably smaller than the normal handle portion provided with a casement window which is typically rotary, and there is a tremendous elimination of components for a casement-type window. In fact, this will be described hereinafter.

Referring to FIG. 17, there is shown an exploded perspective view of the window assembly which will fit into the track profile similar to FIG. 18, but more specifically which may be designed for a casement window. The sashes 220 are provided with an opening 227 wherein a corner connector 280 is provided which extends into the opening 227 proximate all four corners and eliminates the necessity for welding. Clip portions 281 bite into the vinyl and are tapered in a direction so as to prevent the removal of the corner connectors once inserted within opening 227. This snap lock feature therefore provides for the installation of the corner connectors and the quick fastening of the sash profile around the glass G. The track covers 230 are therefore provided and snapped into position once the closed cell foam, best seen in FIG. 15*a* at 240, is inserted within the opening of the sash profile. The hardware including the carriers, best seen in FIG. 18, which are then assembled within the opening opposite the glass of the sash proximate each jamb portion in use. The hardware therefore including the top and bottom track abutting connector portion 39*x* and 37*x*, the shaft 32, the connector 31*bx*, the other shaft 31, and the small shaft 34*c* are provided proximate the pivoting end of the window assembly within the sash profile enclosed by a cover similar to that of cover CX. The central lock as described in relation to FIGS. 16, 16A and 16B is therefore inserted within the other opening of the sash profile and assembled and covered by the cover CX. The window sash is now available for installation within the frame assembly of FIG. 18 once the connectors portions 39*x* are connected to the corners of the sashes and subsequently via the respective shafts 32 and 34*c* to the carriers. The block portions 200 are therefore locked in position once the track is installed in the frame, and the nut portions are adjusted to allow for the parallelism of the carriers within the tracks to ensure the parallelism of the sash so that it rides well within the track portions. The window is therefore assembled.

For a casement window, all of the prior art levers and latch mechanisms are substantially eliminated. This means a great deal to window manufacture in that there are a considerable number of screws and fasteners to hold down the prior art lever linkages of the prior art systems. In the present invention, only the latch block fasteners are provided. The rest of the window assembly merely snaps together with a friction fit of the sash profiles, the sash profile covers and the frames. A minimum of assembly labour is therefore required with the installation of this window assembly. In one particular situation where an old style double-hung window is installed within an opening, it may be conveniently removed by an installer and the present invention may be installed in any of its embodiments including a casement window.

This is heretofore unknown in that a casement window occupies a certain standard space in the industry, and because of the linkage systems and the known systems, it is not possible to provide a larger window. With the present invention, a larger casement window may be provided which is easily installed with the minimum amount of labour and assembly time required. Should the window now be misaligned for any reason, it may be easily adjusted by the rotation of the screw 206 provided. A sophisticated user therefore could easily adjust this once instructed over the phone by an installer, or alternatively the installer may return for a quick adjustment at any time. Also, the window assembly is less likely to go out of adjustment because of the great care taken in the development of the precision of the assembly.

A method therefore of assembling the window may be considered as described in the above-mentioned description wherein, firstly the sash components are assembled by the quick fastening feature of the corner locking portions which are inserted within the opening of the sash profiles provided and provide one-way friction fit. The closed cell caulking is therefore inserted within the top and bottom of the sash assembled and these portions are covered by the track covers by the compression of the closed cell foam and the engagement of the tabs of the track cover with the tabs of the sash profile. The hardware is then installed along the vertical portions of the sash within the openings thereof opposite the glass which is then covered by a sash cover portion provided. The hardware located proximate the pivoting end is therefore installed on the carrier portions and inserted within the track portion within the sill and header, for example of a window assembly. The window is therefore closed in position with the sash covers or track covers located proximate the sill and header snapping into the frame and closing any path for air to enter the window and pass the primary seals provided as best seen in relation to the FIG. 15A. The track covers also provide blockage of light, air and the friction fit of the sash into the track portions. By providing a track cover along the track remote the pivoting end of the window, this track cover may be used as support as well for the window assembly.

In another embodiment not shown, a double casement window is provided which is provided in a straight-line window, that is to say a frame is provided wherein a central mullion is disposed. A central mullion separates two casement windows, one opening as a mirror image of the other and containing all of the elements described above in relation to the pivot assembly and the central locking system and track system.

As many changes can be made to the preferred embodiments of the invention without departing from the scope or intent thereof; it is intended that all matter contained herein be considered as illustrative of the invention and not in a limiting sense.

The embodiments of the invention the in which an exclusive property of privilege is claimed are as follows:

1. A closure assembly having two ends comprising a first and second track disposed proximate each end of the assembly respectively, and a slidable and pivotable closure member, the closure member including framing sections therefor and being engaged with the first and second tracks proximate first and second pivots adjacent the pivotable end of the member, the first and second pivots being interconnected by a multiple segment shaft disposed within framing sections of said closure member, the shaft including at least two portions, the shaft providing for accurate installation, retention, removal, adjustment and alignment of the first and second pivots within the first and second tracks in a substantially parallel line with respect to one another and for pivotally supporting the closure member which may be safely and securely pivoted away from the closure assembly, whereby the first and second interconnected pivots are adapted to remain engaged with the first and second tracks while supporting the closure member both when it is pivoted away from the closure assembly and when it is slidable relative to the tracks.

2. A pivoting and sliding closure assembly comprising:

i) an opening extending within a frame ii) the frame having two ends and having disposed therein or attached thereto proximate each end track portions extending in a substantially parallel said frame;

iii) at least one closure member having framing portions and two ends and being slidable within said track portions and pivotable proximate at least one end thereof and latchable in the track portions proximate the other end thereof;

iv) each of said track portions having disposed therein at least one pivot shoe adjacent the pivoting end of the closure member, each shoe being substantially compatibly shaped with the track portions and having a top and bottom, each shoe having disposed therein adjacent the pivoting end of the at least one closure member an opening extending from the top toward the bottom of the shoe wherein pivot means are disposed, said pivot means provided with said pivot shoe being interconnected by a multiple segment shaft disposed within said framing portions of said at least one closure member, the shaft including at least two portions, the shaft providing for accurate installation, retention, removal, adjustment and alignment of the first and second pivots within the track portions in a substantially parallel line for pivotally supporting the at least one closure member for safe and secure pivoting away from the closure assembly;

v) the at least one closure member having latching means provided therewith for latching the at least one closure member in relation to the track portions to prevent the at least one closure member from pivoting upon the pivot means when the at least one closure member remains slidable with said track portions;

vi) the at least one closure member being braced by the multiple segment shaft interconnecting the pivot means disposed with each track portions, the substantially parallel alignment of the pivot means provided by the multiple segment shaft preventing the pivot means from misaligning or disengaging from the relevant track portions when the at least one closure member is rotated to an open position or when it remains slidable within said track.

3. A pivoting and sliding closure assembly comprising:

i) an opening extending within a peripheral frame said peripheral frame including a header portion, a sill portion and two vertically extending jamb portions;

ii) the sill and header portions or the two jamb portions having disposed therein or attached thereto track portions extending in a substantially parallel direction to said peripheral frame portions;

iii) at least one closure member having two ends and framing portions and being slidable within said track portions and pivotable proximate at least one end thereof and latchable in the track portions proximate the other end thereof;

iv) each of the track portions having disposed therein adjacent the pivoting end of the at least one closure member, at least one pivot shoe, each pivot shoe being substantially compatibly shaped with the track portions and having a top and bottom, each pivot shoe having disposed therein adjacent the pivoting end of the at least one closure member an opening extending from the top toward the bottom of the shoe wherein pivot means are disposed, said pivot means being interconnected by a multiple segment shaft disposed within the said framing portions of said at least one closure member, the shaft including at least two portions, the shaft providing for accurate installation, retention, removal, adjustment and alignment of the pivot means in a substantially parallel line for pivotally supporting the at least one closure member for safe and secure pivoting away from the closure assembly;

v) the at least one closure member having latching means provided therewith for latching the at least one closure member in relation to the track portions to prevent the at least one closure member from pivoting upon its pivot means when the at least one closure member remains slidable with said track portions;

vi) the at least one closure member being braced by the multiple segment shaft which provides for accurate installation, retention, removal, adjustment and alignment of the interconnected pivot means disposed with each track portion, the substantially parallel line of the pivot means provided by the multiple segment shaft preventing the at least one closure member from misaligning or disengaging from the relevant track portion when rotated to an open position or when the at least one closure member remains slidable within said track portions.

4. The assembly of claim 1, 2, or 3 wherein the first and second pivot portions further comprise a rotatable pinion disposed therewith for facilitating the movement of the carrier relative to the track.

5. The assembly of claim 4 wherein the rotatable pinion moves in cooperation with a rack disposed with said track.

6. Hardware for a closure assembly, said closure assembly having a track and a slidable and pivotable closure member, the closure member being engaged with the track proximate first and second pivots adjacent the pivotable end of the member, the hardware comprising the first and second pivots being interconnected by a multiple segment shaft which provides for accurate installation, retention, removal, adjustment and alignment of the first and second pivots in a substantially parallel line for pivotally supporting the closure member when the hardware is installed in said closure assembly so that it may be safely and securely pivoted away from the closure assembly, whereby the first and second interconnected pivots when the hardware is installed in said closure assembly are adapted to remain engaged with the track while supporting the closure member both when it is pivoted away from the closure assembly and when it is slidable relative to the track.

7. The hardware of claim 6 wherein said hardware is embodied in a casement window wherein a link having two ends is fastened at one end proximate the center of the bottom of the window sash and proximate the other end adjacent the end of the sill of the window frame to allow for full operation of the casement window from a fully closed to a fully open position and the movement of the pivoting end of the window towards the opposite end so as to allow full access to the outside of the window and the easy cleaning thereof.

8. The hardware of claim 7 wherein the link is removable to allow total reversing of the window for cleaning and/or removal purposes.

9. The assembly of claim 1, 2, 3, or 6 wherein a retractable screen is provided disposed within the jamb of the assembly which accumulates on and pays out from a spring biased roll disposed within said jamb, the screen being retractable for egress or cleaning purposes, and available as desired by providing a detent on the opposite jamb engageable with the screen when in its operatable position.

10. The assembly of claim 5 wherein the frame portions are formed separately from the track, the track further comprising an integral rack portion proximate one side thereof, said rack portion including a plurality of teeth extending substantially from end to end of said track, and for engagement with the rotatable pinion of said carrier which facilitates the movement of the carrier relative to the track, the track being fixed in position relative to the frame portions by the provision of two supplementary portions, the first supplementary portion being a first block which has two ends, a top and a bottom, the first block having disposed in use proximate the top thereof openings to receive fasteners wherein said openings extend to the bottom of the first block, the fasteners for engagement with the frame portion of the frame and are provided to lock the first block in position in relation to the end of the track remote the pivoting end of the closure member, and thereby fixing the track in position, a second block having disposed therewith an adjuster moveable in relation to said first block in a direction extending towards said track, said adjuster being engageable with a second supplementary portion, for engagement with said track, the second portion having elements provided therewith which are engageable with said adjuster and said track, said adjuster being moveable in position to move the track abutting portions in relation to the rack provided with the track, wherein movement of said adjuster will move said second portion in relation to said track and said rack in a direction toward and away from the first block thereby adjusting the position of said track in relation to said frame portions and thereat fixing said rack in position wherein such an adjustment for the track establishes and allows for the alignment or adjustment of the closure member and maintains the parallelism of the carrier in relation to said tracks so that the pivots remain substantially parallel and square to one another.

11. The assembly of claim 10 wherein aluminum is used for the track.

12. The assembly of claim 10 wherein the adjuster is a rotatable cap screw preferably having an opening therein for an allen key, and which is contained within an opening proximate one end of the first block remote the track and wherein said cap screw is threaded into a second block or preferred nut, wherein rotation of the screw in relation to the fixed block, for example by an allen key, will cause the second block or preferred nut to move fore and aft in relation to the track and provide for a final adjustment or readjustment of the track in relation to the carrier in both the top and bottom or side tracks of the window system depending on what window system is used.

13. The assembly of claim 10 wherein the block is manufactured from aluminum, and the adjuster nut is manufactured from Delrin(™).

14. The assembly of claim 10 wherein the block and nut are manufactured from fiber filled nylon.

15. The assembly of claim 10 further comprising a second nut wherein both the first block and the second nut include a detent, for example a right angled triangle notch proximate the top thereof for engagement with a lock in use for a pivoting window, the lock being compatible with the detent.

16. The assembly of claim 10 wherein a pivot shoe is provided for engagement with said rack and track further comprising a carrier having a top and a bottom, the carrier having disposed proximate the bottom thereof means, and preferably slots, for retaining rollers, and the rollers in use thereof for providing the smooth movement of the carrier within the track, preferably the rollers being engaged with a predetermined channel formed in said track, said carrier also having an opening disposed proximate the top thereof wherein a pivot gear is disposed, said pivot gear having a top and a bottom and having disposed primate the top thereof a pivot engaging portion for engaging the pivot of a closure member such as a window sash, said pivot gear having disposed proximate the bottom thereof an anti-thrusting wheel portion for engagement with a shoulder provided proximate each side of the track channel, for example to engage the shoulder of the channel as a result of thrust which may be caused by the wind load on the closure member and the normal thrust caused by meshing of gears, the anti-thrusting wheel preferably being of a predetermined diameter of a dimension less than the channel of the track so as to minimize drag in the track, said pivot gear having disposed intermediate said pivot engaging portion and said anti-thrust wheel portion a pinion gear portion for engaging the rack, wherein the closure member and specifically the pivots thereof engages with the carrier portion, wherein movement of said carrier portion will affect rotation of said pinion in relation to said track and the smooth movement of the carrier along the track maintaining the parallelism, of said upper and lower pinions for the case of both a tilt and slide and casement window, and said left and right pinions in the case of double hung windows.

17. The assembly of claim 16 wherein said carrier portion is made from Delrin(™), and said pivot gear portion is made from nylon.

18. The assembly of claim 1, 2, or 3 wherein a profile forming the closure member (for example a sash profile) is provided and further comprises a cover disposed on the side of the profile opposite a glass, which cover extends substantially along the length of the profile and which has disposed proximate the sides thereof two flanges for locking engagement underneath flanges provided with the profile, said profile further including a space defined within said profile enclosed by said cover, said space containing in use a closed cell foam or the like, for example a closed cell caulking foam, which is compressible, said cover having disposed proximate the bottom thereof intermediate said flanges spring-loaded members, for example fingers, engageable with said foam, and preferably when installed slightly loading said foam to create a spring biased resistance of the foam against the cover further locking the cover in position with the profile, the cover is made from flexible material and when installed extends down from said profile toward the space defined within said track portion between the flanges thereof, the cover providing a locking flexible seal throughout the length of the closure member with the exception of the area adjacent the carrier portion located proximate the pivoting end of said closure member; wherein the use of a closed cell foam such as caulking foam or the like in the space within the profile provides resilience and strength to the cover along the length of the profile and therefore allows for the foam and cover together to provide a surface upon which the closure member may travel while the carrier moves in the track, the cover behaving as a seal for the profile and in use indirectly for the track to keep dust and other undesirable elements out of the track and out of the profile, and assists to prevent passing cold air.

19. The assembly of claim 18 wherein the cover is embodied with a casement window, a tilt and slide window or a double-hung window.

20. The assembly of claim 1, 2 or 3 wherein there is provided a release mechanism for locking a closure member from pivoting movement in a closure assembly, said closure assembly including opposed detent portions disposed adjacent the track thereof, said release mechanism further comprising operating means disposed with the closure member, said operating means being provided intermediate the lockable ends of the closure member, and accessible to the user, the operating means being disposed in a predetermined plane provided with a sash element so that the operating means when operated will cause the locking and unlocking of the closure member and allow free movement thereof, the operating means being operable by the user to and from a locked and released position to allow movement of the closure member, the locking means provided with the sash profile being moveable by the operation of said operating means to cause locking portions engaged with said locking means to move in and out of engagement with the detent portions disposed proximate at least two opposed locations of said closure assembly, the operation of the operating means in a first direction causing the locking portion to move out of engagement with the detent provided with the track, to therefore allow pivoting movement of the closure member, the movement of the operating means in the second direction causing the locking portions to move into engagement with the detent provided with the track and therefore prevent the pivoting movement of the closure member.

21. The assembly of claim 20 wherein the release mechanism for locking a closure, member includes a handle portion which has provided proximate one end thereof a handle and proximate the other end thereof a pinion, said pinion being engageable with a rack portion proximate one side thereof and a second rack portion proximate the other side thereof, said rack portions being engaged with locking portions which extend to the track or detent provided with the track in use to latch and unlatch the closure assembly.

22. The assembly of claim 21 wherein a casement window is provided with release mechanism, the pinion portion also engaging one of the rack portions which further engages a second pinion rotatable by the motion of the second rack, the second pinion being engageable with a latch portion including a pinion sector provided therewith, causing the rotation of the latch portion into and out of engagement with a detent portion provided proximate the jamb of a casement window assembly, said single handle therefore operating both the locks proximate the track portion and when a casement window is used the lock proximate the jamb portion.

23. The assembly of claim 1, 2, or 3 wherein there is provided a casement window assembly further comprising a jamb portion located proximate the pivoting end of a casement window, preferably said window including a clip in flexible cover for the sash, said jamb portion including a pocket portion extending substantially towards the casement window sash and providing a pocket for the pivoting end of the casement window wherein said carrier is disposed in use, thereby providing a recess or pocket within which the closed casement window proximate the pivoting end thereof is located and when a cover is provided with the sash to snap fit into, to improve the seal and weatherproofing of the casement window, said pinion upon pivoting of the casement window causing the rotation of said gears and the sliding motion of the pivoting end of the window away from the jamb pocket thereof to prevent binding of the pivoting end with the pocket extending with the jamb portion, thereby providing the sealing improvements to the casement window, wherein when the casement window is moved to the closed position, the pivoting end will move back into the pocket provided.

24. A conversion kit of components for a frame opening to convert a double-hung window or a tilt and slide window to a casement window assembly, said kit comprising framing portions for containing track portions engageable with the framing portions of the window, said track portion including a rack portion proximate at least one side thereof, a casement window sash having a carrier and interconnecting pivot assembly provided therewith and for insertion and operation with respect to the track portions of the frame, wherein when assembled said casement window fully fills the space occupied by the previously installed double-hung or tilt and slide window.

25. The kit of claim 24 wherein the window sash includes a central locking handle and racks and pinions therefore contained in the sash adjacent the opening end of the sash and wherein the window sash contains the interconnecting pivot assembly for the pivots adjacent the pivoting end.

26. The assembly of claim 1, 2, or 3 further comprising a straight line window frame and assembly having a center mullion wherein casement windows are disposed on each side of the mullion with the operating portions including the carrier and interconnected pivot assembly and shafts thereof, thereby providing a double-casement window, wherein said casement windows pivot in substantially opposite directions, and provide a straightline window when in the closed position.

27. The assembly of claim 1, 2, or 3 further comprising a cover for a tilt and slide window track, the track comprising a first half and a second half interconnected to provide a continuous track for the window, the first half being disposed below the closed window, and the second half being provided as a continuation of the first half, the second half including a track cover portion which clips into position to engage flange portions of a sill of the window and thereby provide support for the window as it glides along the second half of the track.

* * * * *